US009387686B2

(12) United States Patent
Yoshida

(10) Patent No.: US 9,387,686 B2
(45) Date of Patent: Jul. 12, 2016

(54) CONTROL DEVICE

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/722,415

(22) Filed: May 27, 2015

(65) Prior Publication Data

US 2015/0343812 A1 Dec. 3, 2015

(30) Foreign Application Priority Data

May 30, 2014 (JP) ..... 2014-113240

(51) Int. Cl.
*B41J 29/38* (2006.01)
*B41J 2/21* (2006.01)
*B41J 13/00* (2006.01)

(52) U.S. Cl.
CPC ..... *B41J 2/2132* (2013.01); *B41J 13/0027* (2013.01)

(58) Field of Classification Search
CPC ..... B41J 25/001; B41J 13/0027
USPC ..... 347/9
See application file for complete search history.

(56) References Cited

U.S. PATENT DOCUMENTS 6,511,144 B2 * 1/2003 Otsuki ..... B41J 11/06 347/104
6,896,432 B2 5/2005 Ohyama
2002/0130942 A1 * 9/2002 Walker ..... B41J 2/125 347/105
2004/0183879 A1 * 9/2004 Nakazawa ..... B41J 2/06 347/101
2005/0030333 A1 2/2005 Takahashi et al.
2007/0057996 A1 3/2007 Yazawa et al.
2015/0035891 A1 2/2015 Yoshida et al.

FOREIGN PATENT DOCUMENTS

JP 2001-315314 A 11/2001
JP 2005-059318 A 3/2005

(Continued)

OTHER PUBLICATIONS

U.S. Office Action issued in related U.S. Appl. No. 14/333,899, mailed Mar. 12, 2015.
U.S. Appl. No. 14/333,899, as originally filed Jul. 17, 2014.

(Continued)

*Primary Examiner* — Stephen Meier
*Assistant Examiner* — Alexander D Shenderov
(74) *Attorney, Agent, or Firm* — Merchant & Gould P.C.

(57) ABSTRACT

A control device may specify a target transportation pathway to be used for transporting a target print medium, select one type of printing control in accordance with the specified target transportation pathway, and control a print performing unit in accordance with the selected one type of printing control. In each of a first type of printing control and a second type of printing control, when a central image is to be printed, the target print medium is transported by a first transportation amount. In the first type of printing control, when an edge image is to be printed, the target print medium is not transported by a transportation amount greater than the first transportation amount. In the second type of printing control, when the edge image is to be printed, the target print medium is transported by a second transportation amount greater than the first transportation amount.

19 Claims, 12 Drawing Sheets

(56) References Cited

FOREIGN PATENT DOCUMENTS

| | | | |
|---|---|---|---|
| JP | 2005-271231 | A | 10/2005 |
| JP | 2006-44060 | A | 2/2006 |
| JP | 2006-103278 | A | 4/2006 |
| JP | 2010-179656 | A | 8/2010 |

OTHER PUBLICATIONS

U.S. Office Action issued in related U.S. Appl. No. 14/333,899, mailed Sep. 2, 2015.

U.S. Office Action (Notice of Allowance) issued in related U.S. Appl. No. 14/333,899, mailed Feb. 10, 2016.

* cited by examiner

Normal Control

Normal Control

Special Control

Special Control

FIG. 12

(First Embodiment)

Printing Control Table DT1

| Pathway Type | Sheet Type | Printing Control | |
|---|---|---|---|
| Upper Feed | Resin Glossy Sheet | Normal | Inhibition of Banding |
| | Cast Glossy Sheet | Special | Inhibition of Contamination Due to Curl |
| | Inkjet Sheet | Special | |
| | Normal Sheet (Thick Sheet) | Special | |
| Concave Deformation | Normal Sheet (Thin Sheet) | Special | Inhibition of Contamination Due to Cockling |
| | OHP | Normal | Inhibition of Banding |
| Lower Feed | Resin Glossy Sheet | Normal | Inhibition of Banding |
| | Cast Glossy Sheet | Normal | |
| | Inkjet Sheet | Normal | |
| | Normal Sheet (Thick Sheet) | Normal | |
| Convex Deformation | Normal Sheet (Thin Sheet) | Special | Inhibition of Contamination Due to Cockling |
| | OHP | Normal | Inhibition of Banding |

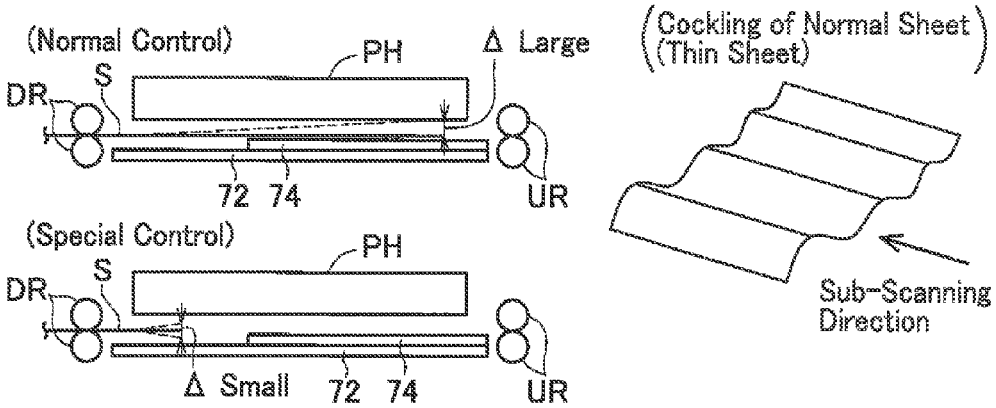

(Second Embodiment)

Printing Control Table DT2

| Pathway Type | Printing Control | |
|---|---|---|
| Upper Feed | Special | Inhibition of Contamination Due to Curl |
| Lower Feed | Normal | Inhibition of Banding |

CONTROL DEVICE

CROSS-REFERENCE TO RELATED APPLICATIONS

This application claims priority to Japanese Patent Application No. 2014-113240, filed on May 30, 2014, the contents of which are hereby incorporated by reference into the present application.

TECHNICAL FIELD

The present specification discloses a control device configured to cause a print performing unit to perform printing.

DESCRIPTION OF RELATED ART

An ink jet type printer is widely known. In this type of printer, a print medium is transported from a feed tray or the like toward a printing head, then the print medium is sequentially transported a plurality of times along a sub-scanning direction from an upstream side toward a downstream side, and the printing head performs a main-scanning action each time the transportation has been completed. In the main-scanning action, the printing head discharges ink toward the print medium while the printing head moves along a main-scanning direction.

For example, a technique is known for executing a countermeasure against curling of a recording medium which may occur at the time of automatic two-sided recording. In this technique, recording information is obtained, this including information indicating the type of recording medium, information indicating whether two-sided recording is to be performed, information indicating whether to use an automatic two-sided recording unit, etc. Then, recording data is created in accordance with the type of recording medium and the type of recording (i.e. normal recording that is not two-sided recording, two-sided recording that uses an automatic two-sided recording unit, two-sided recording that does not use the automatic two-sided recording unit), and printing is performed according to the recording data.

SUMMARY

However, conventionally, printing in accordance with a transportation pathway has not been considered sufficiently. The present specification provides a novel technique that may allow printing to be performed appropriately in accordance with a transportation pathway.

A control device may be configured to cause a print performing unit to perform printing. The print performing unit may comprise: a printing head comprising a plurality of nozzles which align along a first direction; a medium transportation unit configured to transport a print medium toward the printing head by using one of plural types of transportation pathways, the plural types of transportation pathways including a first type of transportation pathway that may deform the print medium convexly toward the printing head and a second type of transportation pathway that may deform the print medium concavely toward the printing head; a head driving unit configured to cause the printing head to perform a main-scanning action, the main-scanning action including an action for causing the printing head to discharge an ink toward the print medium while causing the printing head to move along a second direction which is perpendicular to the first direction. The control device may comprise: a processor; and a memory storing computer-readable instructions which, when executed by the processor, cause the control device to execute: specifying a type of a target print medium to be used for printing from among plural types of print mediums; specifying a type of a target transportation pathway to be used for transporting the target print medium from among the plural types of transportation pathways; selecting, in accordance with the specified type of the target print medium and the specified type of the target transportation pathway, one type of printing control from among plural types of printing controls including a first type of printing control and a second type of printing control; and controlling the print performing unit in accordance with the selected one type of printing control so as to cause the print performing unit to perform printing of a target image on the target print medium. In each of the first type of printing control and the second type of printing control, the medium transportation unit may sequentially transport a plurality of times, from an upstream side to a downstream side along the first direction, the target print medium which has been transported along the target transportation pathway, and the head driving unit may cause the printing head to perform the main-scanning action each time the target print medium is transported. In each of the first type of printing control and the second type of printing control, when a central image among the target image is to be printed on a central area which is located at a central portion along the first direction on the target print medium, the medium transportation unit may sequentially transport the target print medium more than once by a first transportation amount. In the first type of printing control, when an edge image among the target image is to be printed on an edge area which is located at an edge portion along the first direction on the target print medium, the medium transportation unit may not transport the target print medium by a transportation amount which is greater than the first transportation amount. In the second type of printing control, when the edge image among the target image is to be printed on the edge area on the target print medium, the medium transportation unit may transport the target print medium by a second transportation amount which is greater than the first transportation amount.

A control device may comprise: a processor; and a memory storing computer-readable instructions which, when executed by the processor, cause the control device to execute: specifying a type of a target transportation pathway to be used for transporting a target print medium to be used for printing from among plural types of transportation pathways; selecting, in accordance with the specified type of the target transportation pathway, one type of printing control from among plural types of printing controls including a first type of printing control and a second type of printing control; and controlling the print performing unit in accordance with the selected one type of printing control so as to cause the print performing unit to perform printing of a target image on the target print medium A printer comprising the aforementioned print performing unit, the processor, and the memory is also novel and useful. A system comprising the print performing unit and the control device are novel and useful. Further, a control method and computer-readable instructions for implementation of the controlling device, and a non-transitory computer-readable recording medium in which the computer-readable instructions are stored, are also novel and useful.

BRIEF DESCRIPTION OF THE DRAWINGS

FIG. 12 shows a printing control table.

EMBODIMENT

Figure 1:
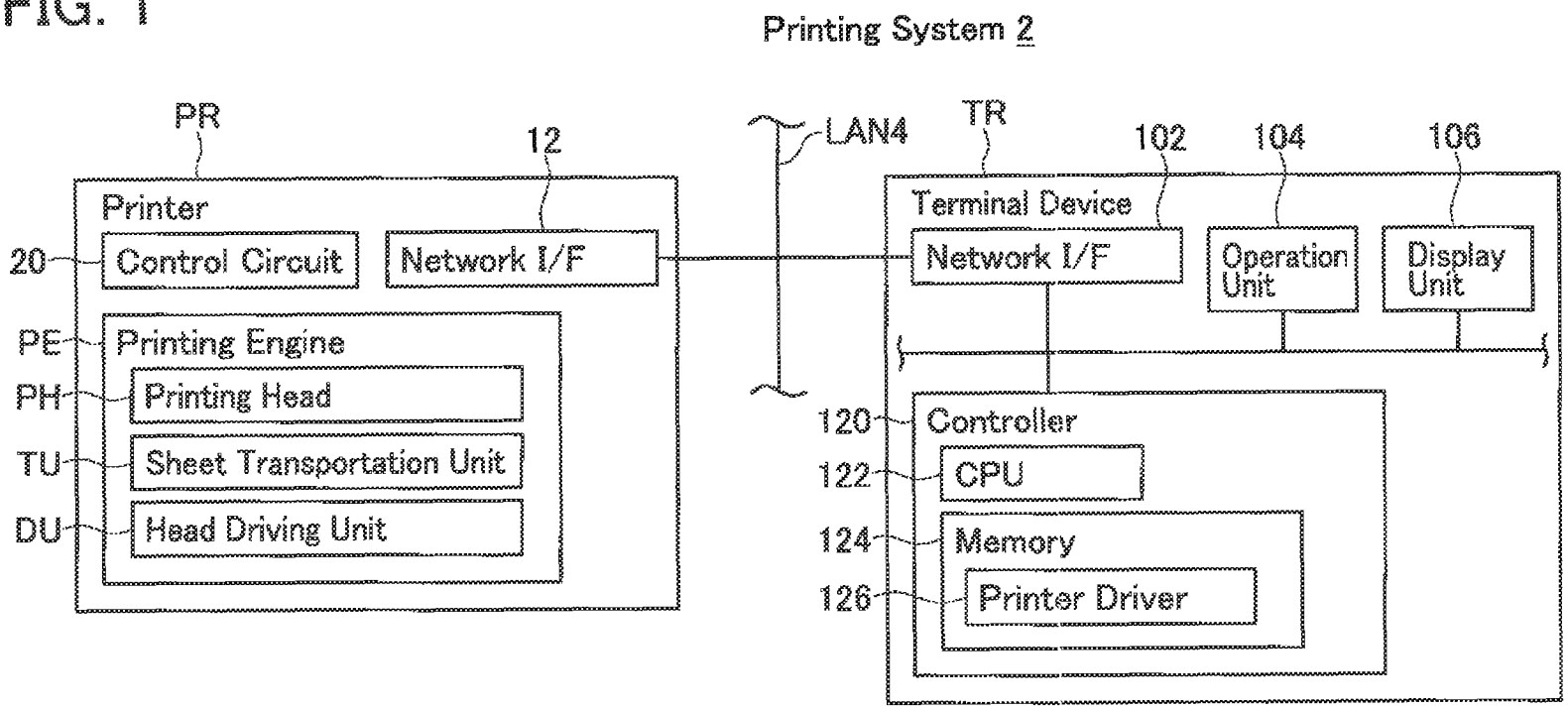
FIG. 1 shows a configuration of a printing system.

First Embodiment (Configuration of Printing System 2; FIG. 1)

As shown in FIG. 1, a printing system 2 comprises a printer PR and a terminal device TR. The printer PR and the terminal device TR can communicate with each other via a LAN 4.

(Configuration of Printer PR)

The printer PR comprises a network I/F 12, a control circuit 20, and a printing engine PE. The network I/F 12 is connected with the LAN 4. The control circuit 20 comprises a CPU and a memory (not shown), and performs various processes to cause the printing engine PE to perform printing. The printing engine PE comprises a printing head PH, a sheet transportation unit TU, and a head driving unit DU.

Figure 2:
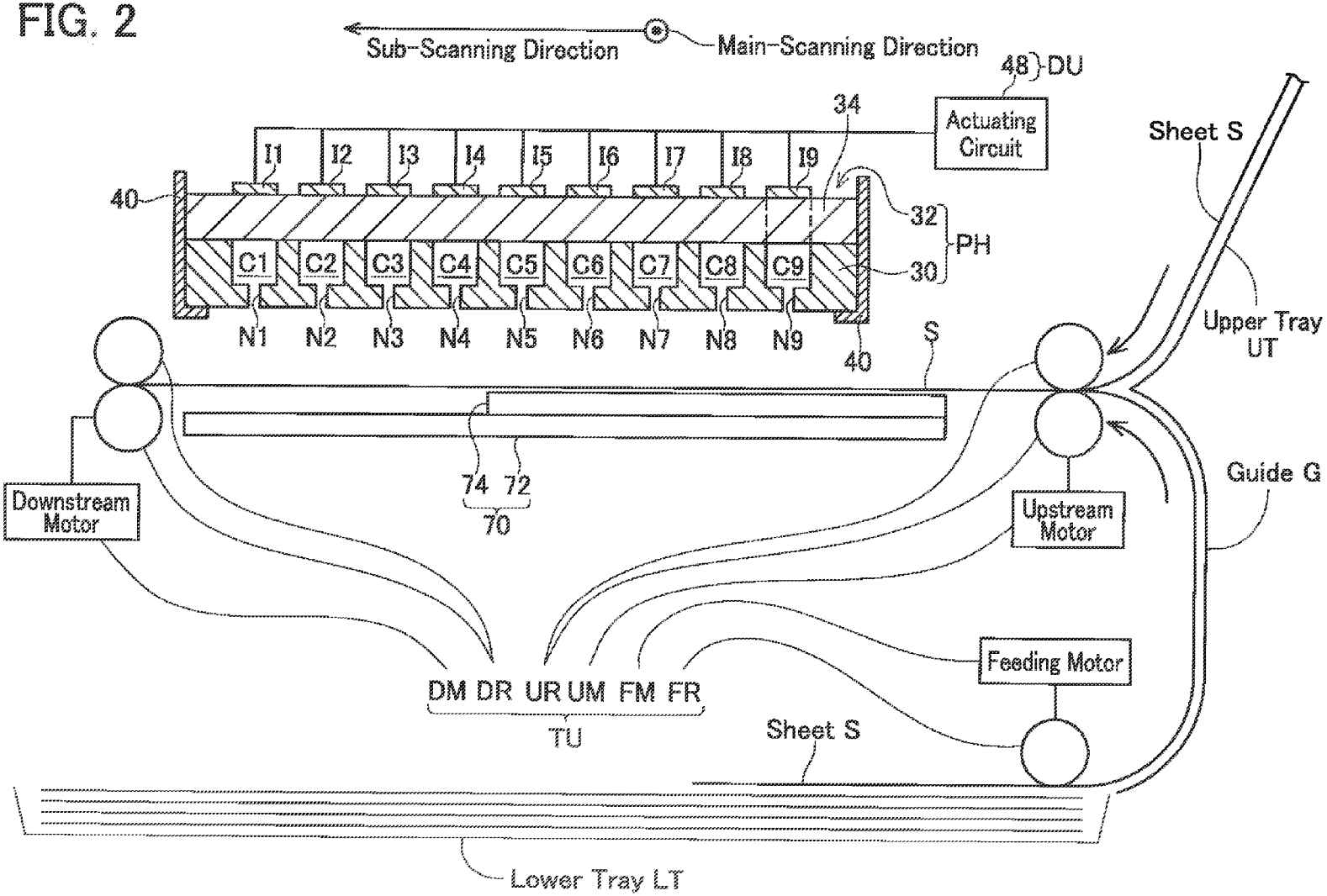
FIG. 2 shows a configuration of a part of a printing engine.

As shown in FIG. 2, the printer PR further comprises a lower tray LT and an upper tray UT. The lower tray LT and the upper tray UT are each capable of supporting a plurality of sheets S. The lower tray LT is below the printing head PH, and is disposed within a housing (not shown) of the printer PR. The printer PR further comprises a guide G having a curved shape that is between the lower tray LT and the printing head PH. The sheets S supported by the lower tray LT are transported along the guide G toward the printing head PH from a lower side toward an upper side. Below, transportation of the sheet S from the lower tray LT to the printing head PH is called "lower feed". Further, the upper tray UT is attached to the housing so as to extend above the printing head PH. The sheets S supported by the upper tray UT are transported toward the printing head PH from the upper side toward the lower side. Below, transportation of the sheet S from the upper tray UT to the printing head PH is called "upper feed". Thus, the printer PR comprises two types of transportation pathway (i.e., lower feed and upper feed) for transporting the sheet S toward the printing head PH.

Figure 3:
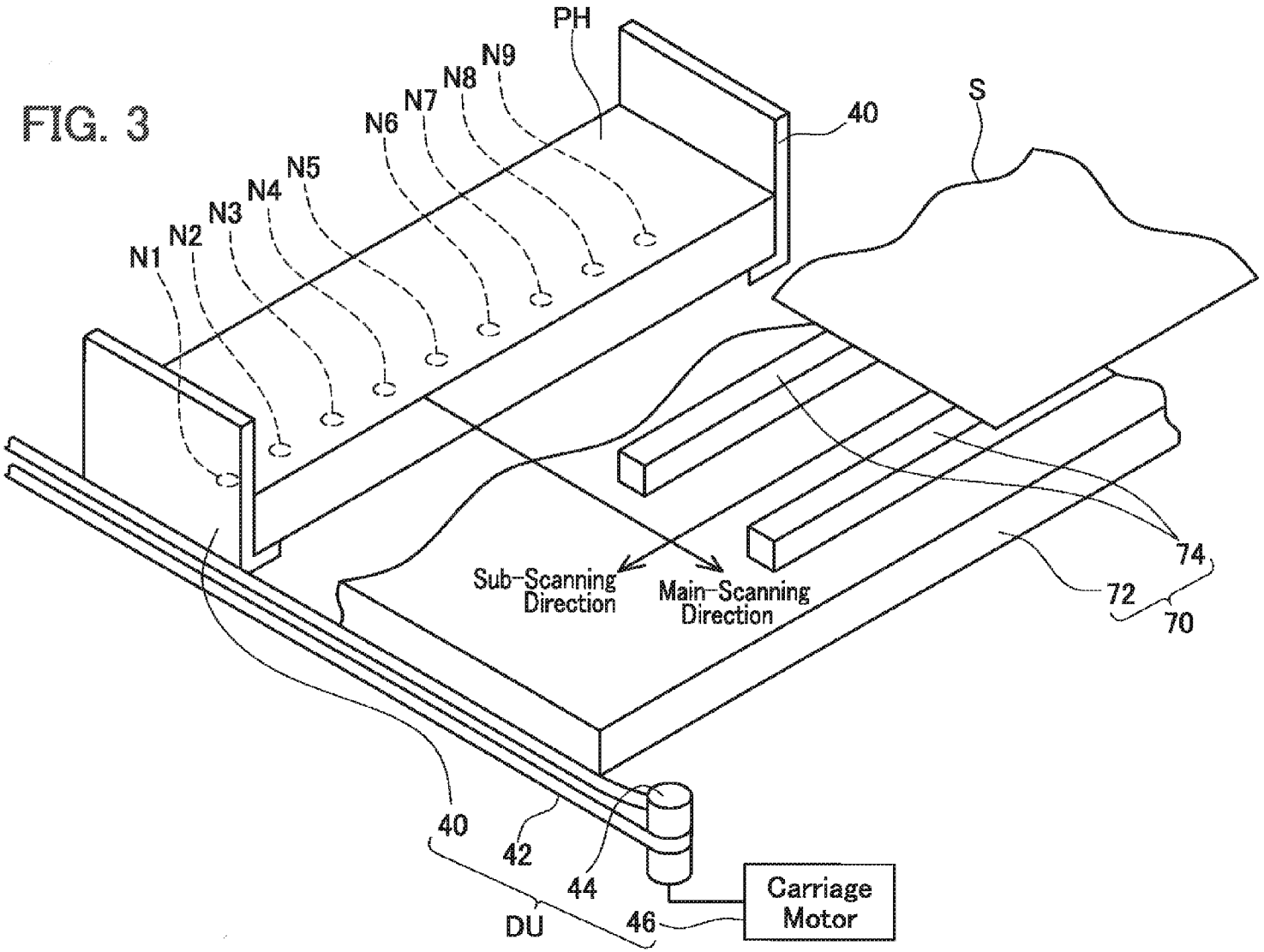
FIG. 3 shows a perspective view of a part of a printing engine.

(Configuration of Printing Engine PE; FIG. 2, FIG. 3)

FIG. 2 shows the configuration of a part of the printing engine PE. In FIG. 2, a direction perpendicular to a sheet surface along which the printing head PH moves when performing printing of the sheet S is a main-scanning direction, and a leftward direction along which the sheet S moves when performing printing of the sheet S is a sub-scanning direction. The sheet transportation unit TU comprises a feeding roller FR, and a feeding motor FM which drives the feeding roller FR. The feeding roller FR transports the sheets S supported by the lower tray LT toward the printing head PH (more specifically, toward an upstream roller pair UR). That is, the feeding roller FR is a roller for performing the lower feed.

The sheet transportation unit TU further comprises the upstream roller pair UR, an upstream motor UM which drives one roller of the upstream roller pair UR, a downstream roller pair DR, and a downstream motor DM which drives one roller of the downstream roller pair DR. Moreover, in FIG. 2, one of the upstream roller pair UR and one of the downstream roller pair DR is shown. However, in reality, a plurality of upstream roller pairs UR is aligned in the direction perpendicular to the sheet surface of FIG. 2, and a plurality of downstream roller pairs DR is aligned in the direction perpendicular to the sheet surface of FIG. 2. The upstream roller pairs UR and the downstream roller pairs DR are disposed respectively, in the sub-scanning direction, at an upstream side from the printing head PH (i.e., the right side of FIG. 2), and a downstream side from the printing head PH (i.e., the left side of FIG. 2). In the case where the lower feed is to be performed, the upstream roller pairs UR transport the sheet S, which has been transported by the feeding roller FR, to a predetermined print starting position. Further, in the case where the upper feed is to be performed, the upstream roller pairs UR transport the sheet S supported by the upper tray UT to the predetermined print starting position. The upstream roller pairs UR further transport the sheet S from the predetermined print starting position toward the downstream roller pairs DR. The downstream roller pairs DR transport the sheet S, which has been transported by the upstream roller pairs UR, toward a discharge tray (not shown).

As described above, in the case where the lower feed is to be performed, the sheet S is transported to the predetermined print starting position by the feeding roller FR and the upstream roller pairs UR. Further, in the case where the upper feed is to be performed, the sheet S is transported to the predetermined print starting position by only the upstream roller pairs UR. Then, the sheet S is transported by the upstream roller pairs UR and the downstream roller pairs DR in the left direction of FIG. 2 (i.e., the sub-scanning direction) from the predetermined print starting position.

The printing head PH comprises an ink passage unit 30 and an actuator unit 32. A plurality (nine in FIG. 2) of nozzles N1 to N9 for discharging black (K) ink droplets is formed in a lower surface of the ink passage unit 30. Moreover, the number of nozzles is not limited to nine and may be two or more. The nozzles N1, etc. are aligned at equal intervals on a straight line along the sub-scanning direction. A plurality (nine in FIG. 2) of pressure chambers C1 to C9 is further formed in the ink passage unit 30. Black ink is filled in the pressure chambers C1, etc. Each nozzle N1, etc. communicates with a different one of the pressure chambers C1, etc.

The actuator unit 32 is bonded to an upper surface of the ink passage unit 30. The actuator unit 32 comprises a laminated body 34, and a plurality (nine in FIG. 2) of individual electrodes I1 to I9. The laminated body 34 has been formed by laminating a plurality of piezoelectric sheets and a common electrode sheet. The individual electrodes I1, etc. are disposed on an upper surface of the laminated body 34. Each individual electrode I1, etc. is disposed at a position corresponding to each one different pressure chamber C1, etc. When an actuation signal is supplied from an actuating circuit 48, to be described, to an individual electrode (e.g., I9) configuring the actuator unit 32, a part of the laminated body 34 corresponding to that individual electrode (e.g., the part inside the two broken lines of FIG. 2) deforms, and consequently there is a pressure change within the pressure chamber (e.g., C9) facing this part. Thereby, ink droplets are discharged from the nozzle (e.g., N9) which communicates with this pressure chamber.

The printer PR further comprises a sheet supporting unit 70. The sheet supporting unit 70 is disposed below the printing head PH, and is disposed between the upstream roller pairs UR and the downstream roller pairs DR. The sheet supporting unit 70 comprises a base unit 72 and a plurality of platens 74. The base unit 72 is substantially plate-shaped. The platens 74 protrude upward from an upper surface of the base unit 72, and support the sheet S transported to a downstream side from the upstream roller pairs UR.

An upstream edge (i.e., right edge of FIG. 2) of the platens 74 in the sub-scanning direction is located at an upstream side (i.e., right side of FIG. 2) from the nozzle N9. A downstream edge (i.e., left edge of FIG. 2) of the platens 74 in the sub-scanning direction is located between the nozzle N4 and the nozzle N5. Consequently, when the printing head PH moves in the main-scanning direction, the nozzles N5 to N9 located at the upstream side in the sub-scanning direction face the platens 74, whereas the nozzles N1 to N4 located at the downstream side in the sub-scanning direction do not face the platens 74. Since the nozzles N1 to N4 do not face the platens 74, the ink discharged from the nozzles N1 to N4 does not adhere to the platens 74. Consequently, by using the nozzles N1 to N4, the printer PR can perform printing in which a blank is not provided at respective edge portions of the upstream side and downstream side of the sheet S in the sub-scanning direction (i.e., so-called marginless printing).

The head driving unit DU comprises the actuating circuit 48. The actuating circuit 48 is connected to the individual electrodes I1, etc., and supplies the actuation signal to the individual electrodes I1, etc. Thereby, the printing head PH is driven, and ink droplets are discharged from the nozzles N1 to N9.

As shown in FIG. 3, the head driving unit DU further comprises a carriage 40, a belt 42, a pair of pulleys 44 (only one pulley 44 is shown in FIG. 3), and a carriage motor 46. The carriage 40 supports the printing head PH. The belt 42 is bonded to the carriage 40. The belt 42 is an endless belt, and is suspended between the pair of pulleys 44. The carriage motor 46 is connected to the pulleys 44. When the carriage motor 46 is driven, the pulleys 44 rotate, and consequently the belt 42 connected to the pulleys 44 rotates. Thereby, the carriage 40 connected to the belt 42, and the printing head PH supported by the carriage 40, move. The carriage 40 moves reciprocally by the carriage motor 46 selectively causing the pulleys 44 to rotate forward and in reverse. The reciprocating movement direction of the carriage 40, i.e., the reciprocating movement direction of the printing head PH, is the main-scanning direction, and the main-scanning direction is perpendicular to the sub-scanning direction.

In the present embodiment, in one time of reciprocating movement along the main-scanning direction, the printing head PH discharges ink toward the sheet S while performing outgoing movement, and does not discharge ink toward the sheet S while performing returning movement. Below, the action of the printing head PH discharging ink while performing outgoing movement is called "main-scanning action". Moreover, in a modification, the printing head PH may discharge ink toward the sheet S while performing outgoing movement in one time of reciprocating movement along the main-scanning direction, and may discharge ink toward the sheet S in the returning movement of the one time of reciprocating movement. In this case, one time of main-scanning action is performed by the printing head PH discharging ink while performing outgoing movement, and one time of main-scanning action is performed by the printing head PH discharging ink while performing returning movement.

(Configuration of Terminal Device TR; FIG. 1)

As shown in FIG. 1, the terminal device TR comprises a network I/F 102, an operation unit 104, a display unit 106, and a controller 120. The network I/F 102 is connected to the LAN 4. The operation unit 104 is configured by a mouse and a keyboard. A user can input various instructions to the terminal device TR by operating the operation unit 104. The display unit 106 is a display for displaying various information. The controller 120 comprises a CPU 122 and a memory 124. The CPU 122 performs various processes in accordance with an OS program (not shown) stored in the memory 124, a printer driver 126 etc.

The printer driver 126 is a program for creating print data from image data representing a target image of a print target and for supplying the print data to the printer PR. The printer driver 126 may, e.g., be installed in the terminal device TR from a computer-readable storage medium storing the printer driver 126, or may be installed in the terminal device TR from a server on the Internet.

The CPU 122 controls the printer PR by supplying print data to the printer PR in accordance with the printer driver 126. As will be described in detail later, the CPU 122 selects one type of printing control among a normal control and a special control, to be described, in accordance with the type of the sheet S (e.g., glossy sheet, normal sheet, etc.), and the transportation pathway of the sheet S (i.e., upper feed, lower feed), and causes the printer PR to perform printing in accordance with the one type of printing control.

Figure 4:
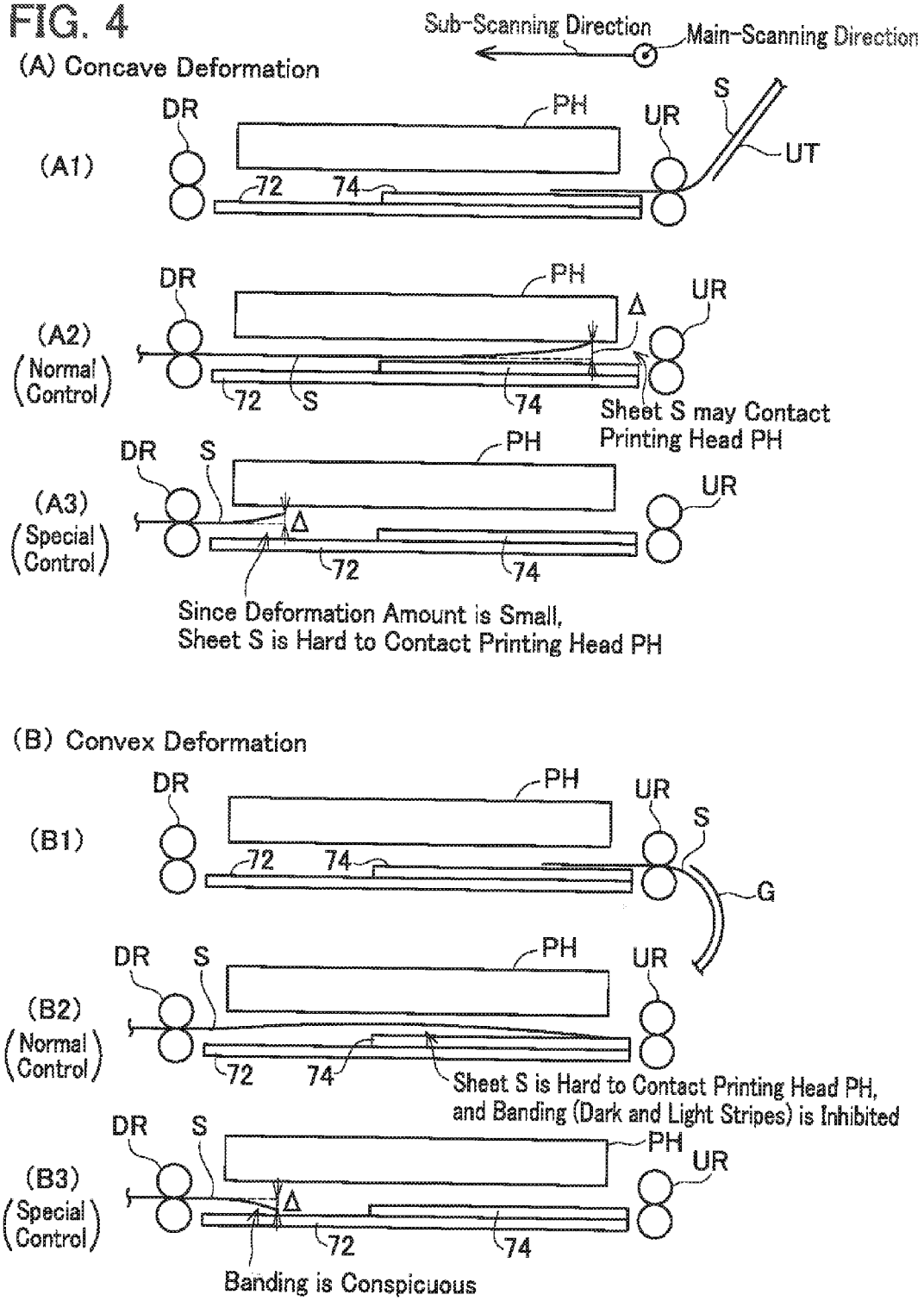
FIG. 4 shows how a sheet is deformed concavely or convexly.

(Deformation of Sheet S; FIG. 4)

Next, the manner in which the sheet S is deformed will be described with reference to FIG. 4. (A) shows how the sheet S is concavely deformed viewed from the main-scanning direction, and (B) shows how the sheet S is convexly deformed viewed from the main-scanning direction. The concave or convex deformation of the sheet S means that the sheet S respectively deforms concavely or convexly toward the printing head PH when the sheet S is transported below the printing head PH. Moreover, below, downstream and upstream in the sub-scanning direction will omit "the sub-scanning direction" and be called simply "downstream" and "upstream".

(A1) shows a state where the sheet S has been transported by the upper feed to the predetermined print starting position. The sheet S is supported by the upstream roller pairs UR. A sheet portion located at a downstream side (i.e., left side) from the upstream roller pairs UR extends in the left direction along the platens 74, and a sheet portion located at an upstream side from the upstream roller pairs UR extends in an upper right direction along the upper tray UT. That is, in this state, the sheet S is bent concavely.

(A2) shows how the sheet S is transported in accordance with the normal control. In the normal control, when an upstream side edge of the sheet S (i.e., right side edge portion) is to be printed, the sheet S is not transported by a large transportation amount, to be described, but is transported by a normal transportation amount. In a state where the sheet S is being supported by both the upstream roller pairs UR and the downstream roller pairs DR, a sheet portion between the upstream roller pairs UR and the downstream roller pairs DR is supported horizontally by the platens 74. However, in a state after the sheet S has separated from the upstream roller pairs UR, i.e., in a state where the sheet S is supported only by the downstream roller pairs DR, the sheet S concavely deforms toward the printing head PH. In the normal control, when the upstream side edge of the sheet S is to be printed, the sheet S is not transported by a large transportation amount, and consequently there is a large length of sheet portion located at the upstream side from the downstream roller pairs DR. Consequently, when the sheet S concavely deforms, a deformation amount Δ upwards of an upstream edge (i.e., right edge) of the sheet S becomes large, and when the printing head PH moves in the main-scanning direction, the upstream edge of the sheet S may contact a lower surface of the printing head PH (i.e., the surface in which the nozzles are formed). When such a situation occurs, ink of the lower surface of the printing head PH adheres to the sheet S, thus contaminating the sheet S. To avoid this, in the present embodiment, in the case where the type of the sheet S is a type that deforms comparatively easily, and the sheet S is transported by the upper feed, the special control of (A3), to be described, is performed instead of the normal control of (A2).

(A3) shows how the sheet S is transported in accordance with the special control. In the special control, when the upstream side edge of the sheet S (i.e., the right side edge portion) is to be printed, the sheet S is transported by a large transportation amount. Thereby, when the upstream side edge of the sheet S is to be printed, the length of the sheet portion located at the upstream side from the downstream roller pairs DR becomes smaller, and the deformation amount Δ of the upstream edge (i.e., right edge) of the sheet S becomes smaller. Consequently, when the printing head PH moves in the main-scanning direction, it is possible to inhibit contact of the upstream edge of the sheet S with the lower surface of the printing head PH, and consequently it is possible to inhibit the contamination of the sheet S.

The sheet S may also concavely deform toward the printing head PH in a state where the sheet S is being supported by only the upstream roller pairs UR. In particular, in a state immediately before the downstream edge (i.e., left edge) of the sheet S reaches the downstream roller pairs DR, the length of the sheet portion located at the downstream side from the upstream roller pairs UR is large. Consequently, if the sheet S concavely deforms, the downstream edge of the sheet S may deform upward. However, the downstream side edge of the sheet S (i.e., the left side edge portion) is a portion that is printed before the upstream side edge of the sheet S (i.e., the right side edge portion), and therefore the downstream side edge of the sheet S does not deform upward as easily as the upstream side edge of the sheet S. The reason is believed to be the following two points.

The first reason is as follows. When the upstream side edge of the sheet S is to be printed, i.e., when the sheet S is supported by only the downstream roller pairs DR, there is a long time from when the sheet S was begun to be supported by the upstream roller pairs UR. Thus, the sheet S is bent concavely for a long time, and consequently the upstream side edge of the sheet S easily deforms upward. By contrast, the printing of the downstream side edge of the sheet S is performed immediately after the sheet S has passed through the upstream roller pairs UR. Consequently, when the downstream side edge of the sheet S is to be printed, i.e., when the sheet S is supported by only the upstream roller pairs UR, there is a short time from when the sheet S was begun to be supported by the upstream roller pairs UR. Thus, the sheet S is bent concavely for a short time, and consequently the downstream side edge of the sheet S does not easily deform upward.

The second reason is as follows. When the upstream side edge of the sheet S is to be printed, the printing of the downstream side edge and central portion of the sheet S has been completed, and consequently a large amount of ink is adhering to the sheet S. When the sheet S includes a large amount of ink, it deforms easily. Consequently, the upstream side edge of the sheet S easily deforms upward. By contrast, when the downstream side edge of the sheet S is to be printed, hardly any ink is adhering to the sheet S. Consequently, the downstream side edge of the sheet S does not easily deform upward.

As described above, the downstream side edge of the sheet S does not easily deform upward compared to the upstream side edge of the sheet S. Consequently, when the printing head PH moves in the main-scanning direction, the downstream edge of the sheet S normally does not make contact with the lower surface of the printing head PH. In view of these circumstances, in the present embodiment, when the upstream side edge of the sheet S is to be printed, the sheet S is transported by the large transportation amount (i.e., the special control of (A3)) whereas, when the downstream side edge of the sheet S is to be printed, the sheet S is not transported by the large transportation amount.

(B1) shows a state where the sheet S has been transported by the lower feed to the predetermined print starting position. The sheet S is supported by the upstream roller pairs UR. A sheet portion located at a downstream side (i.e., left side) from the upstream roller pairs UR extends in the left direction along the platens 74, and a sheet portion located at an upstream side from the upstream roller pairs UR extends in a curved shape along the guide G. That is, in this state, the sheet S is bent convexly.

(B2) shows how the sheet S is transported in accordance with the normal control. In a state after the sheet S has separated from the upstream roller pairs UR, i.e., in a state where the sheet S is being supported by only the downstream roller pairs DR, the sheet S deforms convexly toward the printing head PH. However, the upward deformation amount of the central portion of the sheet S is smaller than the upward deformation amount of the upstream edge of the sheet S in (A2) described above. Consequently, even if the sheet S deforms convexly toward the printing head PH, normally the sheet S does not make contact with the lower surface of the printing head PH when the printing head PH moves in the main-scanning direction. As will be described in detail later, when the sheet S is transported in accordance with the normal control, the number of times is comparatively small that the main-scanning action is performed in a state where the upstream edge (i.e., right edge) of the sheet S is not being supported by the platens 74. Consequently, the presence of dark and light stripes (so-called banding) in the print result of the sheet S is not conspicuous to the user. Thus, in the present embodiment, in the case where the type of sheet S is a type that deforms comparatively easily, and when the sheet S is transported by the lower feed, the normal control of (B2) is performed rather than the special control of (B3), to be described.

(B3) shows how the sheet S is transported in accordance with the special control. In the special control, when the upstream side edge of the sheet S is to be printed, the sheet S is transported by the large transportation amount. In this case, the number of times is comparatively large that the main-scanning action is performed in a state where the upstream edge (i.e., right edge) of the sheet S is not being supported by the platens 74. Consequently, the presence of banding in the print result of the sheet S is conspicuous to the user. To avoid this, in the present embodiment, the sheet S is transported in accordance with the normal control of (B2) described above.

Figure 5:
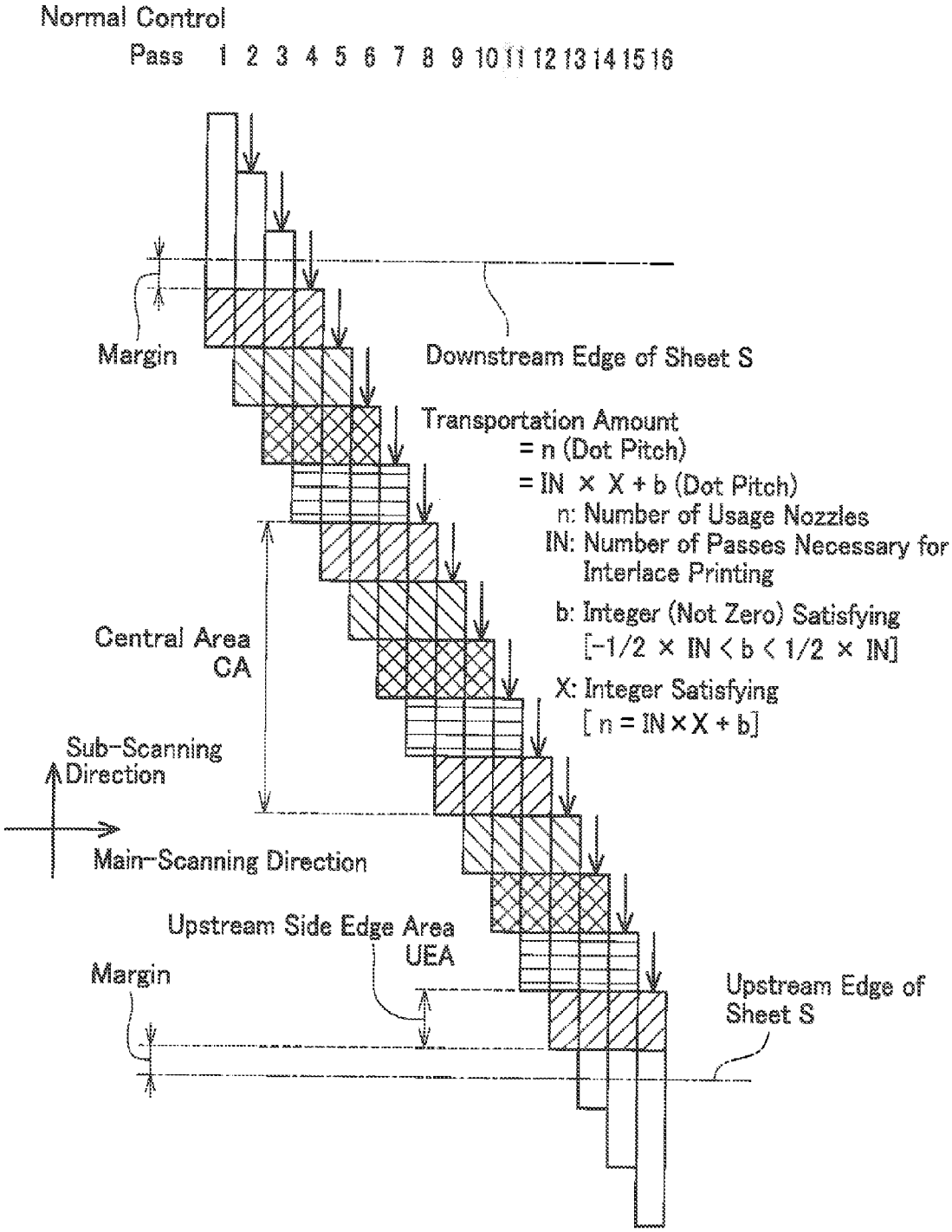
FIG. 5 shows a position of a printing head relative to a sheet in each pass in a normal control.
Figure 6:
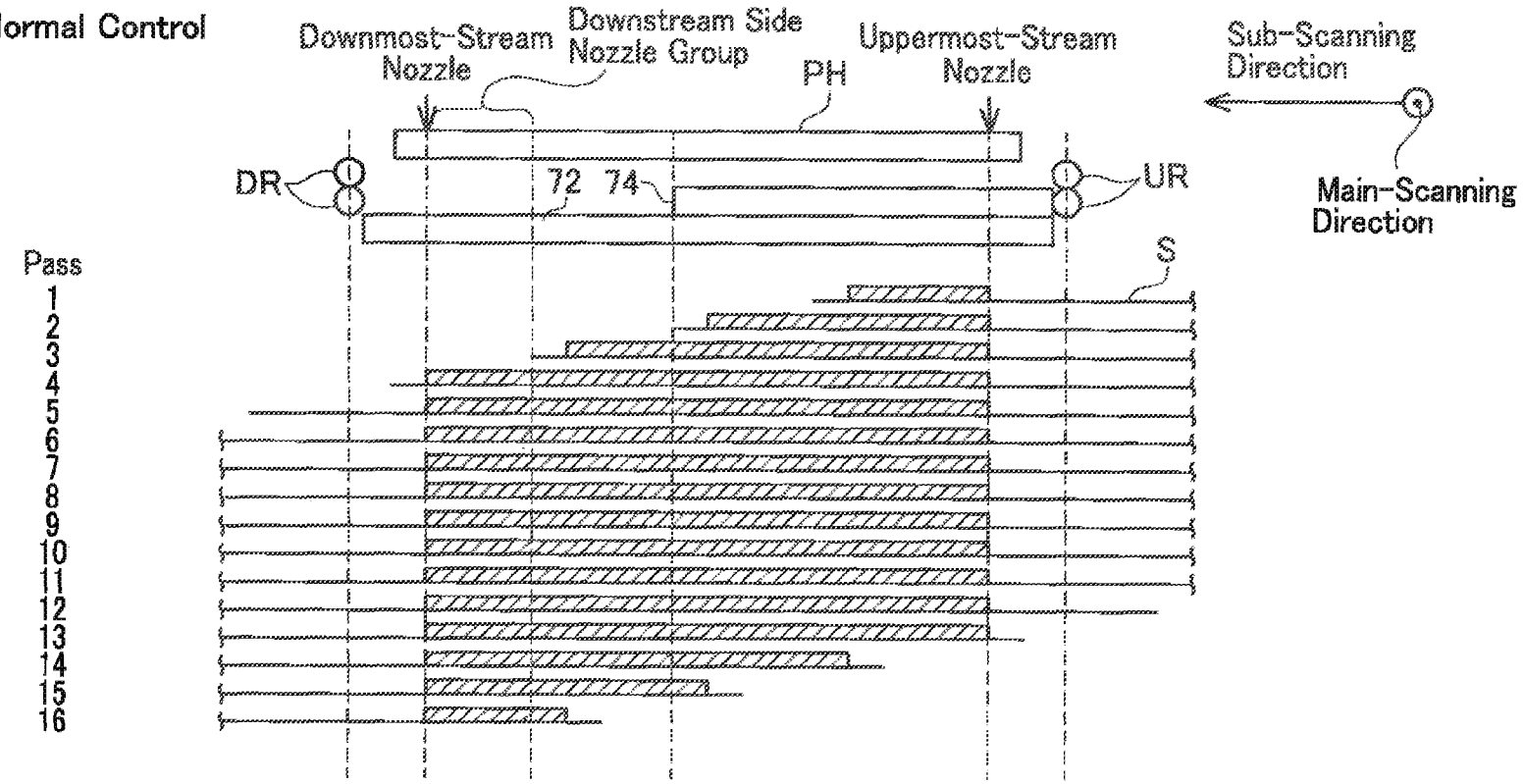
FIG. 6 shows a position of the sheet relative to the printing head in each pass in the normal control.

(Contents of Normal Control; FIG. 5, FIG. 6)

Next, the manner in which the printer PR executes the normal control in accordance with print data obtained from the terminal device TR, and prints an image on the sheet S will be described with reference to FIG. 5 and FIG. 6. In the present embodiment, it is assumed that the printer PR prints a so-called solid image on the sheet S. FIG. 5 shows the manner of relative movement of the printing head PH along the sub-scanning direction with respect to the sheet S. Hatching within the printing head PH indicates the position of a usage nozzle group, this being nozzles whose usage is allowed from among the plurality of nozzles N1 to N9 formed in the printing head PH. That is, in each pass, ink is discharged from the usage nozzle group located at a position indicated by hatching, and ink is not discharged from a non-usage nozzle group at a position not indicated by hatching.

Further, in the present embodiment, the print resolution in the sub-scanning direction is a print resolution for forming four rasters configuring the target image within the length of one nozzle pitch on the sheet S. One nozzle pitch is the distance between two nozzles (e.g., N1 and N2) adjacent in the sub-scanning direction. Further, the raster is a dot group aligned in a straight line along the main-scanning direction on the sheet S. In the present embodiment, four passes (i.e., main-scanning actions) are performed in order to form the four rasters within the length of one nozzle pitch, and this is called "four passes interlace printing". Moreover, in a modification, the print resolution in the sub-scanning direction may be a print resolution for performing interlace printing having a pass number other than four passes.

The control circuit 20 of the printer PR first transports the sheet S to the predetermined print starting position as a preprocess for performing the printing of the first pass. Specifically, in the case where the upper feed is to be performed, the control circuit 20 supplies the driving signal to at least the upstream motor UM (see FIG. 2) of the sheet transportation unit TU, so as to transport the sheet S from the upper tray UT to the predetermined print starting position. Further, in the case where the lower feed is to be performed, the control circuit 20 supplies the driving signal to at least the feeding motor FM and the upstream motor UM (see FIG. 2) of the sheet transportation unit TU, so as to transport the sheet S from the lower tray LT to the predetermined print starting position.

Next, the control circuit 20 supplies the driving signal to the motor UM, etc. of the sheet transportation unit TU, so as to perform transportation of the sheet S for a distance of n dot pitch. Thereby, the sheet S moves to a position at which the main-scanning action of the first pass is to be performed. One dot pitch is the distance between two adjacent dots along the sub-scanning direction on the sheet S. "n" is a maximum number of usage nozzles, among the number of nozzles of each usage nozzle group in all passes (called "number of usage nozzles" below). For example, if a pass is present that all the nine nozzles N1, etc. formed in the printing head PH are to be used, n=9, and consequently the transportation amount of the sheet S is 9 dot pitch.

Generally, if interlace printing is performed, the transportation amount of the sheet S is represented by "IN×X+b (dot pitch)". Here, "IN" is the number of passes necessary for interlace printing (i.e., the number of rasters formed in one nozzle pitch), and in the present embodiment, IN=4. "b" is an integer not including 0 and satisfying "$-(1/2)\times IN<b<(1/2)\times IN$", and in the present embodiment, b=1. "x" is an integer satisfying "n=IN×X+b", and in the present embodiment, X=2 (i.e., "9=(4×X+1)"). Further, in another example, if for example the number of usage nozzles n=13, then X=3 and b=1, and the transportation amount of the sheet S is 13 dot pitch (i.e., (4×3+1) dot pitch).

Next, the control circuit 20 supplies the driving signal to the carriage motor 46 (see FIG. 3) of the head driving unit DU, so as to cause the printing head PH to perform reciprocating movement along the main-scanning direction. The control circuit 20 further supplies the actuation signal to the actuating circuit 48 (see FIG. 2) of the head driving unit DU while the printing head PH is on the outgoing movement of reciprocating movement, so as to cause ink droplets to be discharged from the usage nozzle group. In the first pass, a space is present between the downstream edge of the sheet S and the usage nozzle group. This space corresponds to the length of a blank provided at the downstream side edge of the sheet S. Thereby, margined printing is realized at the downstream side edge of the sheet S.

As with the case of the first pass, in the second and subsequent passes, the control circuit 20 repeatedly performs the combination of transporting the sheet S by n dot pitch and one main-scanning action. In the example of FIG. 5, the printing of the target image onto the sheet S is completed when the printing of the sixteenth pass is performed. Moreover, in the sixteenth pass, a space is present between the upstream edge of the sheet S and the usage nozzle group. This space corresponds to the length of a blank provided at the upstream side edge of the sheet S. Thereby, margined printing is realized at the upstream side edge of the sheet S. When the printing of the target image is completed, the control circuit 20 supplies the driving signal to at least the downstream motor DM (see FIG. 2) of the sheet transportation unit TU, so as to transport the sheet S to the discharge tray. Thereby, the sheet S having the target image formed thereon can be provided to the user.

As described above, in the normal control, the following printing is performed. That is, the sheet transportation unit TU sequentially transports the sheet S, which has been transported by the upper feed or the lower feed to the predetermined print starting position, sixteen times along the sub-scanning direction 16, and each time the sheet S is transported, the head driving unit DU causes the printing head PH to perform the main-scanning action. Further, when a central image in the target image is to be printed at a central area CA in the sub-scanning direction on the sheet S (i.e., fifth to twelfth passes), the sheet transportation unit TU transports the sheet S by n dot pitch. When an upstream side edge image in the target image is to be printed at the upstream side edge area UEA located at the upstream side edge in the sub-scanning direction on the sheet S (i.e., thirteenth to sixteenth passes), also, the sheet transportation unit TU transports the sheet S by n dot pitch. That is, when the upstream side edge image is to be printed on the upstream side edge area UEA, the sheet transportation unit TU does not transport the sheet S by a transportation amount greater than n dot pitch.

FIG. 6 shows how, in the printing of FIG. 5, the sheet S moves along the sub-scanning direction relative to the printing head PH. The hatching on the sheet S for each pass indicates the position of the usage nozzle group in the pass.

In the first to fourth passes, the sheet S is supported only by the upstream roller pairs UR. In the first to fourth passes, the usage nozzle groups are sequentially enlarged from the upstream side toward the downstream side, and consequently the number of usage nozzles sequentially increases. Consequently, the usage nozzle group of the fourth pass is all the nozzles formed in the printing head PH.

In the fifth pass, the sheet S changes from a state of being supported only by the upstream roller pairs UR to a state of being supported by both the upstream roller pairs UR and the downstream roller pairs DR. In the fifth to twelfth passes, the state of all the nozzles being the usage nozzle group is maintained.

In the thirteenth pass, the sheet S changes from the state of being supported by both the upstream roller pairs UR and the downstream roller pairs DR to a state of being supported only by the downstream roller pairs DR. Then, in the thirteenth to sixteenth passes, the usage nozzle group is sequentially reduced from the upstream side toward the downstream side, and consequently the number of usage nozzles sequentially decreases. Further, in the sixteenth pass, the sheet S changes from a state of being supported by the platens 74 to a state of not being supported by the platens 74 (i.e., a state where the sheet S is away from the platens 74).

As shown in FIG. 5, in the thirteenth to sixteenth passes, printing is performed of the upstream side edge area UEA on the sheet S. As shown in FIG. 6, in the thirteenth to sixteenth passes, the downstream side nozzle group present at the downstream side, of the plurality of nozzles N1, etc. formed in the printing head PH, is used continuously. That is, in the normal control, when the upstream side edge area UEA on the sheet S is to be printed (i.e., thirteenth to sixteenth passes), the downstream side nozzle group is used continuously.

Figure 7:
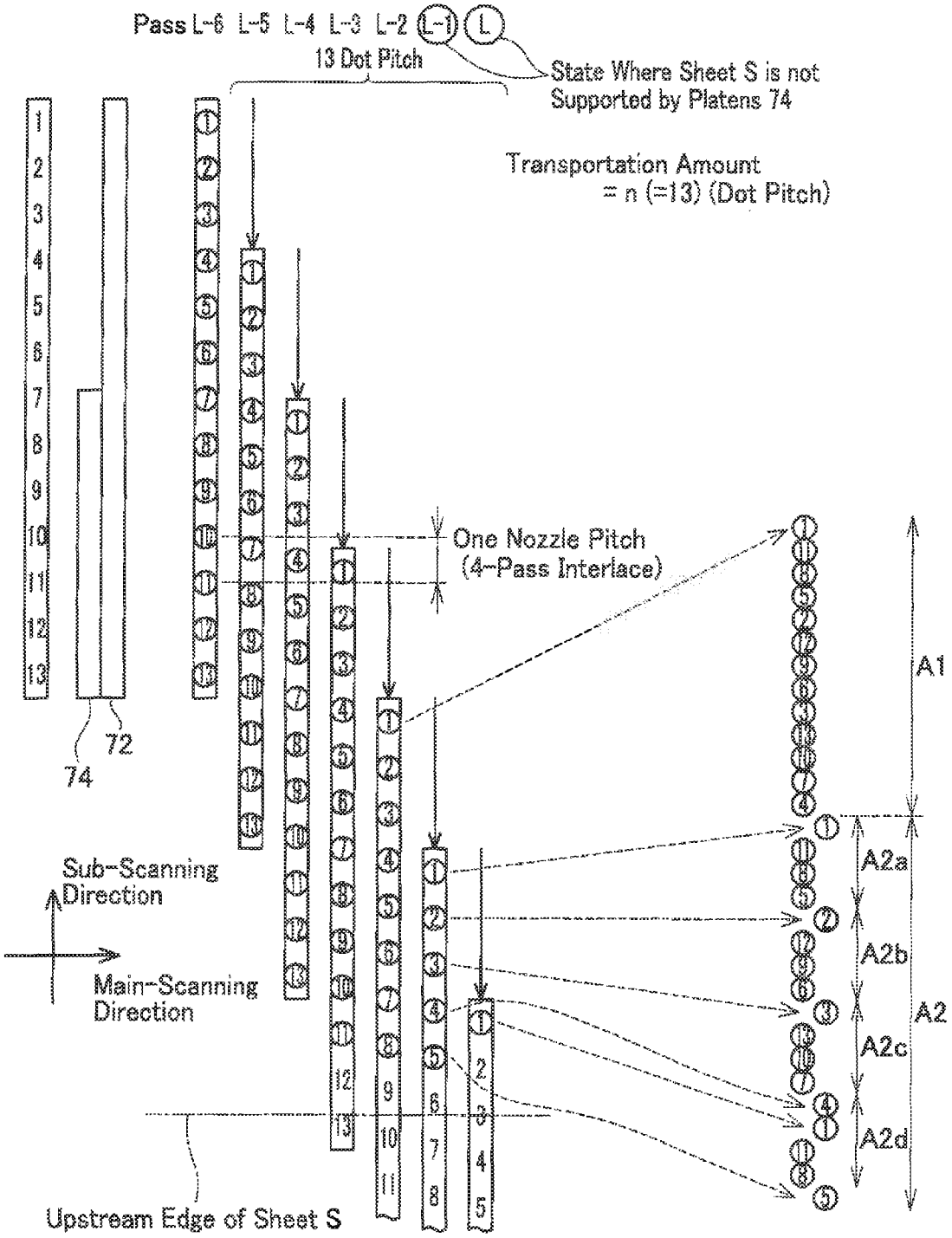
FIG. 7 shows how printing of each pass is performed in an end period of the normal control.

(Details of Printing According to Normal Control; FIG. 7)

Next, the manner in which printing is performed of the upstream side edge area (e.g., the UEA of FIG. 5) on the sheet S in accordance with the normal control will be described with reference to FIG. 7. FIG. 7 shows the manner of relative movement of the printing head PH along the sub-scanning direction with respect to the sheet S. In FIG. 2 and FIG. 3, nine nozzles are formed in the printing head PH. However, in FIG. 7, a configuration is shown as an example in which thirteen nozzles are formed in the printing head PH. The numbers "1" to "13" in the printing head PH indicate the position of each nozzle. That is, the number "1" and the number "13" in the printing head PH respectively indicate the position of a downmost-stream nozzle and an uppermost-stream nozzle. Below, for convenience, a nozzle located at a position indicated by the number "p (p being the integers 1 to 13)" will be referred to as "nozzle [p]". Further, among the numbers in the printing head PH, numbers enclosed by a circle indicate the position of the usage nozzle group, and numbers not enclosed by a circle indicate the position of the non-usage nozzle group.

FIG. 7 shows printing from the L-6 to the L-th pass. The L-th pass is a final pass (e.g., the sixteenth pass of FIG. 5). In the printing of FIG. 6, the sheet S is in a state of not being supported by the platens 74 only at the sixteenth pass, which is the final pass. However, in FIG. 7, for convenience of explanation, the sheet S is in a state of not being supported by the platens 74 at the L-1 pass and the L-th pass.

A space of one nozzle pitch is shown between nozzle [10] and nozzle [11] of the L-6 pass. Within that space, ink is discharged from nozzle [10] of the L-6 pass, nozzle [7] of the L-5 pass, nozzle [4] of the L-4 pass, and nozzle [1] of the L-3 pass. That is, four rasters are formed by four nozzles within the length of one nozzle pitch in the sub-scanning direction on the sheet S, realizing four passes interlace printing. Moreover, forming four rasters during one nozzle pitch means that one nozzle pitch is equal to 4 dot pitch.

For example, in the L-6 pass, all the 13 nozzles are used, and consequently the maximum value of the number of usage nozzles in all the passes is "13". Consequently, in each of the L-6 to L-th passes, 13 dot pitch (i.e., n=13) transport of the sheet S is performed. In the L-6 to L-4 pass, the number of usage nozzles "13" is maintained. In the L-3 to L-th pass, the number of usage nozzles is sequentially reduced to "11", "8", "5", "1".

As shown in (B2) of FIG. 4, in the present embodiment, the normal control is performed in the case where the type of sheet S is a type that deforms comparatively easily, and the sheet S is transported by the lower feed. In the case where the sheet S is transported by the lower feed, since the sheet S deforms convexly toward the printing head PH, the upstream side edge of the sheet S (the right side edge of FIG. 4) deforms downward while the sheet S is in a state of not being supported by the platens 74. That is, when printing is performed while the sheet S is in a state of not being supported by the platens 74, it is possible that the dot is not formed at the target position due to the upstream side edge of the sheet S deforming downward.

The right side of FIG. 7 shows from the dot formed on the sheet S by nozzle [1] of the L-2 pass to the dot formed on the sheet S by nozzle [5] of the L-1 pass (i.e., the dot formed at the uppermost-stream side). In the state where the sheet S is being supported by the platens 74 (i.e., L-6 to L-2 passes), normally each dot is formed at the target position, as shown in area A1. However, in the state where the sheet S is not being supported by the platens 74, the edge portion of the upstream edge of the sheet S deforms downward, and consequently the distance between the printing head PH and the sheet S increases. In this case, when the printing head PH discharges ink droplets while moving from the left side toward the right side of FIG. 7, each dot may be displaced rightward from the target position. For example, the dots formed by nozzle [1] to nozzle [5] of the L-1 pass are displaced rightward from the target position. Further, e.g., the dot formed by nozzle [1] of the L-th pass is displaced rightward from the target position.

The area A1 is an area in which each dot is aligned on a straight line along the sub-scanning direction due to each dot being formed at the target position. Consequently, the area A1 can be called a "good area". Further, the area A2 is an area including dots formed at a displaced position from the target position, and each dot is not aligned on a straight line along the sub-scanning direction. Consequently, the area A2 can be called a "bad area". As described above, since dots that are displaced from the target position are present in the area A2, banding may be conspicuous to the user. However, the banding is less conspicuous to the user in the normal control than in the special control. The reason will be described after describing the contents of the special control.

Figure 8:
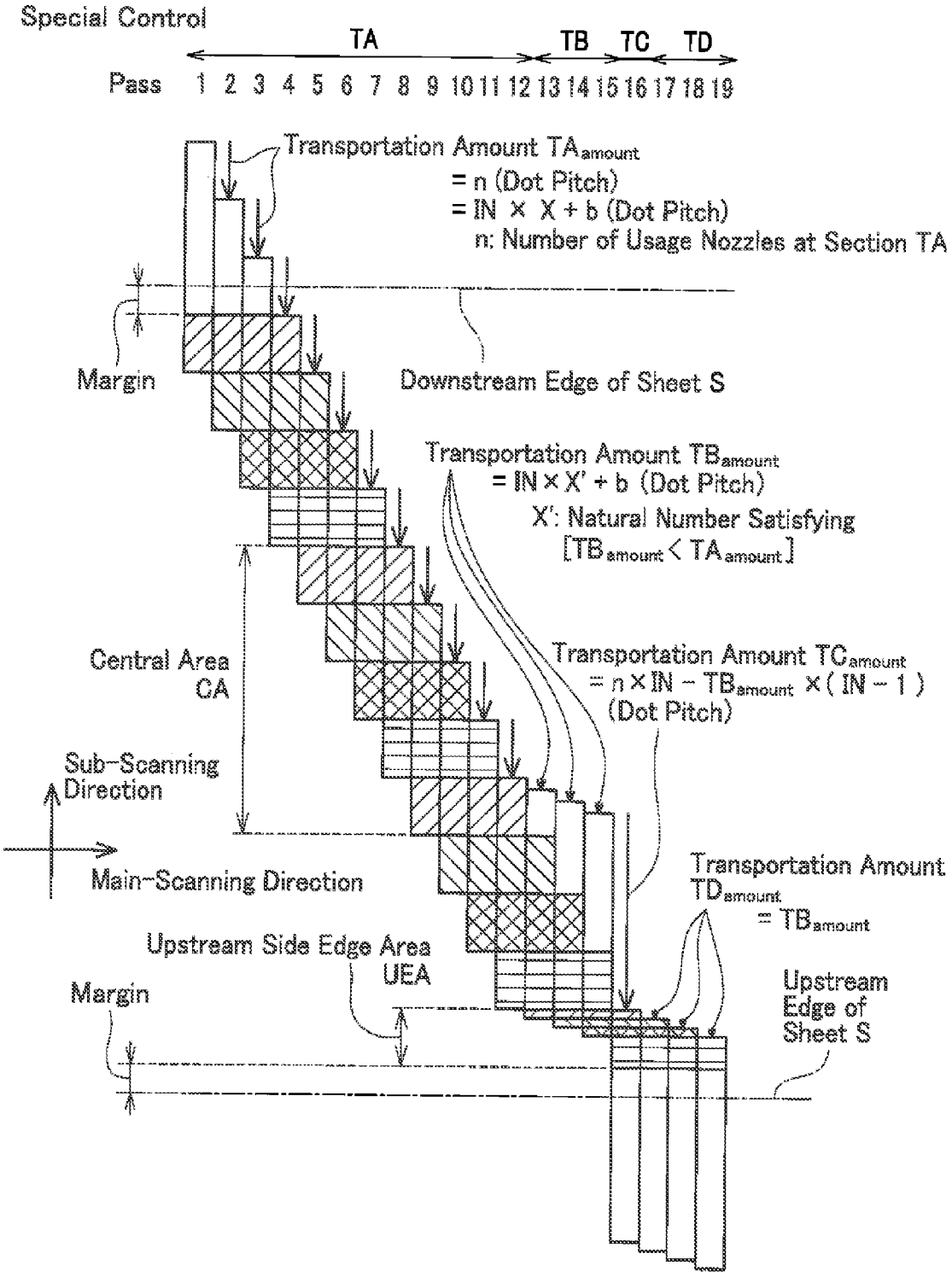
FIG. 8 shows the position of the printing head relative to the sheet in each pass in a special control.
Figure 9:
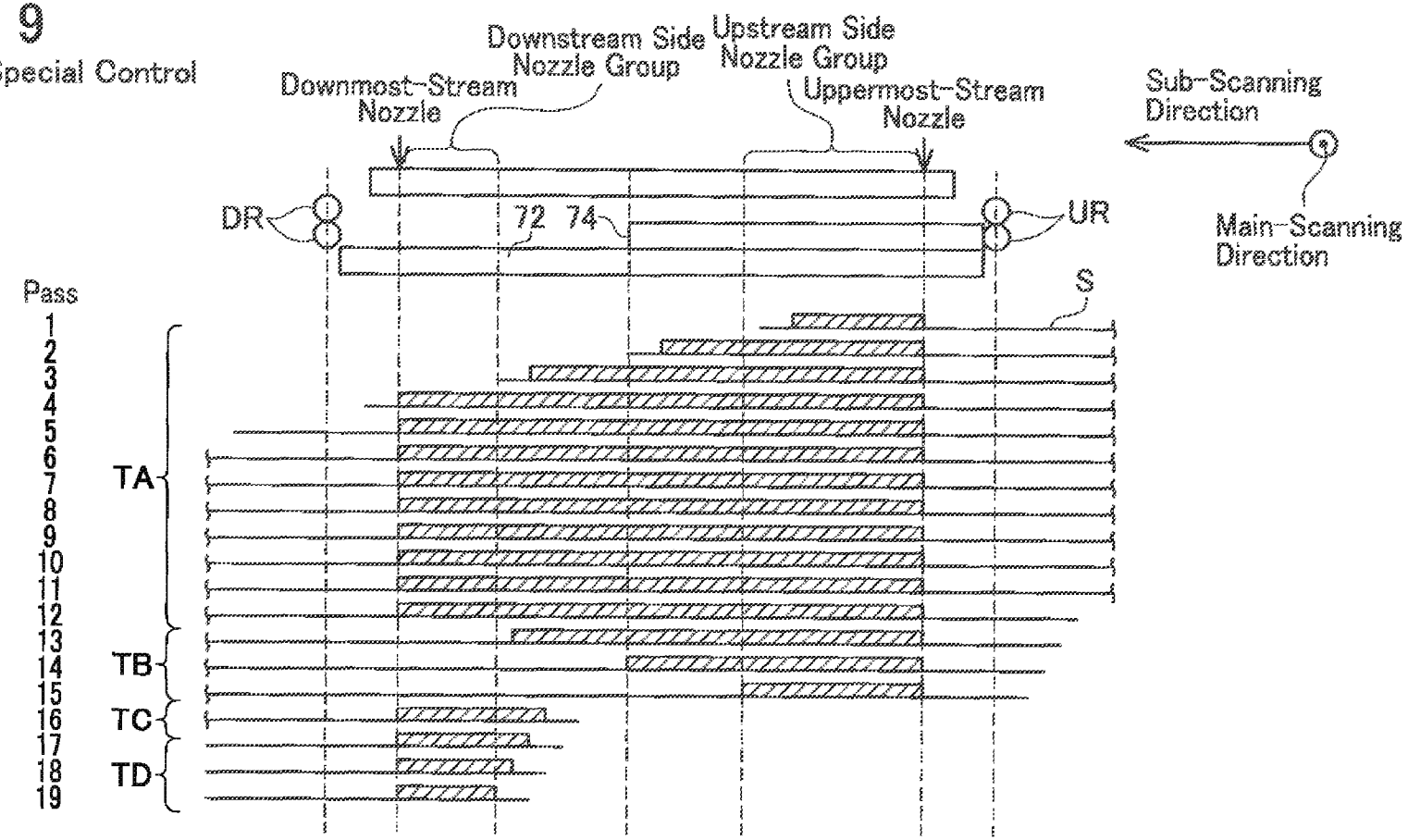
FIG. 9 shows the position of the sheet relative to the printing head in each pass in the special control.

(Contents of Special Control; FIG. 8, FIG. 9)

Next, the manner in which the control circuit 20 of the printer PR performs the special control in accordance with print data obtained from the terminal device TR will be described with reference to FIG. 8 and FIG. 9. FIG. 8 shows the manner of relative movement of the printing head PH along the sub-scanning direction with respect to the sheet S. In the printing of FIG. 8, a target image the same as the target image to be printed in FIG. 5 (i.e., normal control) is printed onto a sheet S having the same size as the sheet S used in FIG. 5. Below, the description will focus on differences from the printing of FIG. 5.

A section TA of first to twelfth passes is the same as the first to twelfth passes of FIG. 5. That is, in the section TA, the control circuit 20 repeatedly performs the combination of transporting the sheet S by the distance of n dot pitch and one main-scanning action. As with the case of the normal control, a transportation amount $TA_{amount}$ (i.e., n dot pitch) of the section TA is represented by "IN×X+b (dot pitch)". For example, in the case where the number of usage nozzles of the section TA is n=9, the $TA_{amount}$=9 (dot pitch) (i.e., "4×2+1"). Further, e.g., in the case where the number of usage nozzles of the section TA is n=13, the $TA_{amount}$=13 (dot pitch) (i.e., "4×3+1").

In a section TB of thirteenth to fifteenth passes, the control circuit 20 transports the sheet S by a transportation amount smaller than the transportation amount $TA_{amount}$ (i.e., n dot pitch) of the section TA. A transportation amount $TB_{amount}$ of the section TB is represented by "IN×X'+b (dot pitch)". Here, "X'" is a natural number including zero and satisfying $TB_{amount}<TA_{amount}$ (i.e., n dot pitch). For example, in the case where IN=4, b=1, and, n=9, X'=0 or 1. That is, in the present example, the $TB_{amount}$ is 1 dot pitch (i.e., "4×0+1") in the case where X'=0, and the $TB_{amount}$ is 5 dot pitch (i.e., "4×1+1") in the case where X'=1. Further, e.g., in the case where IN=4, b=1, and n=13, X'=0, 1, or 2. That is, in the present example, the $TB_{amount}$ is 1 dot pitch (i.e., "4×0+1") in the case where X'=0, the $TB_{amount}$ is 5 dot pitch (i.e., "4×1+1") in the case where X'=1, and the $TB_{amount}$ is 9 dot pitch in the case where X'=2. Moreover, below, the transportation amount $TB_{amount}$ of the section TB may be called "small transportation amount".

In a section TC of a sixteenth pass, the control circuit 20 transports the sheet S by a transportation amount greater than n dot pitch. A transportation amount $TC_{amount}$ of the section TC is represented by the formula "n×IN−$TB_{amount}$×(IN−1) (dot pitch)". Here, "n×IN (dot pitch)" is the distance between the uppermost-stream nozzle and the downmost-stream nozzle formed in the printing head PH. Further, a transportation amount $TD_{amount}$ of a section TD, to be described, is equal to $TB_{amount}$, and consequently "$TB_{amount}$×(IN−1) (dot pitch)" is a total transportation amount in three times of transporting the sheet S in the section TD, to be described. Consequently, $TC_{amount}$ is obtained by subtracting the total transportation amount from the aforementioned distance. For example, in the case where n=9 and $TB_{amount}$=1 (dot pitch), $TC_{amount}$33 (dot pitch) (9×4−1×(4−1)). Further, e.g., in the case where n=13 and $TB_{amount}$=5 (dot pitch), $TC_{amount}$=37 (dot pitch) (13×4−5×(4−1)). Moreover, below, the transportation amount $TC_{amount}$ of the section TC may be called "large transportation amount". When the sheet S is transported by the large transportation amount, as shown in (A3) of FIG. 4, the length of the sheet portion located at the upstream side from the downstream roller pairs DR can be made small while the sheet S is in a state of being supported by only the downstream roller pairs DR. Consequently, it is possible to inhibit the occurrence of the upstream edge of the sheet S being contaminated due to the upstream edge of the sheet S making contact with the lower surface of the printing head PH.

In the section TD of the seventeenth to nineteenth passes, the control circuit 20 transports the sheet S by a transportation amount smaller than n dot pitch. A transportation amount TD amount of the section TD is equal to the transportation amount $TB_{amount}$ of the section TB (i.e., small transportation amount).

As described above, the following printing is performed in the special control. That is, the sheet transportation unit TU sequentially transports the sheet S, which has been transported by the upper feed or the lower feed to the predetermined print starting position, nineteen times along the sub-scanning direction 19, and the head driving unit DU causes the printing head PH to perform the main-scanning action each time the sheet S is transported. Further, when a central image (i.e., fifth to twelfth passes) of the target image is to be printed on the central area CA on the sheet S, the sheet transportation unit TU transports the sheet S by n dot pitch. Then, when an upstream side edge image (i.e., thirteenth to nineteenth passes) of the target image on the upstream side edge area UEA on the sheet S is to be printed, the sheet transportation unit TU transports the sheet S by a transportation amount greater than n dot pitch (37 dot pitch in the above example of n=13).

FIG. 9 shows the manner of movement of the sheet S along the sub-scanning direction relative to the printing head PH in the printing of FIG. 8. The section TA of the first to twelfth passes is the same as the first to twelfth passes of FIG. 6. In the section TB of the thirteenth to fifteenth passes, the sheet S is transported by a small transportation amount. In the section TB, the usage nozzle group is sequentially reduced from the downstream side toward the upstream side, thus sequentially reducing the number of usage nozzles.

In the section TC of the sixteenth pass, the sheet S is transported by a large transportation amount. In the sixteenth pass, the sheet S changes from a state of being supported by the platens 74 to a state of not being supported by the platens 74. In the section TD of the seventeenth to nineteenth passes, the sheet S is transported by a small transportation amount. Then, in the section TD, the usage nozzle group is sequentially reduced from the upstream side toward the downstream side, thus sequentially reducing the number of usage nozzles.

As shown in FIG. 8, in the thirteenth to nineteenth passes, printing is performed of the upstream side edge area UEA on the sheet S. As shown in FIG. 9, in the thirteenth to fifteenth passes, before the sheet S is transported by a large transportation amount, the downstream side nozzle group is not used, and the upstream side nozzle group is used. Further, in the sixteenth to nineteenth passes, after the sheet S has been transported by the large transportation amount, the upstream side nozzle group is not used, and the downstream side nozzle group is used. That is, in the special control, when the upstream side edge area UEA on the sheet S (i.e., the thirteenth to nineteenth passes) is to be printed, the downstream side nozzle group is not used and the upstream side nozzle group is used before the sheet S is transported by the large transportation amount, (i.e., the thirteenth to fifteenth passes), and the upstream side nozzle group is not used, and the downstream side nozzle group is used after the sheet S has been transported by the large transportation amount (i.e., the sixteenth to nineteenth passes).

Figure 10:
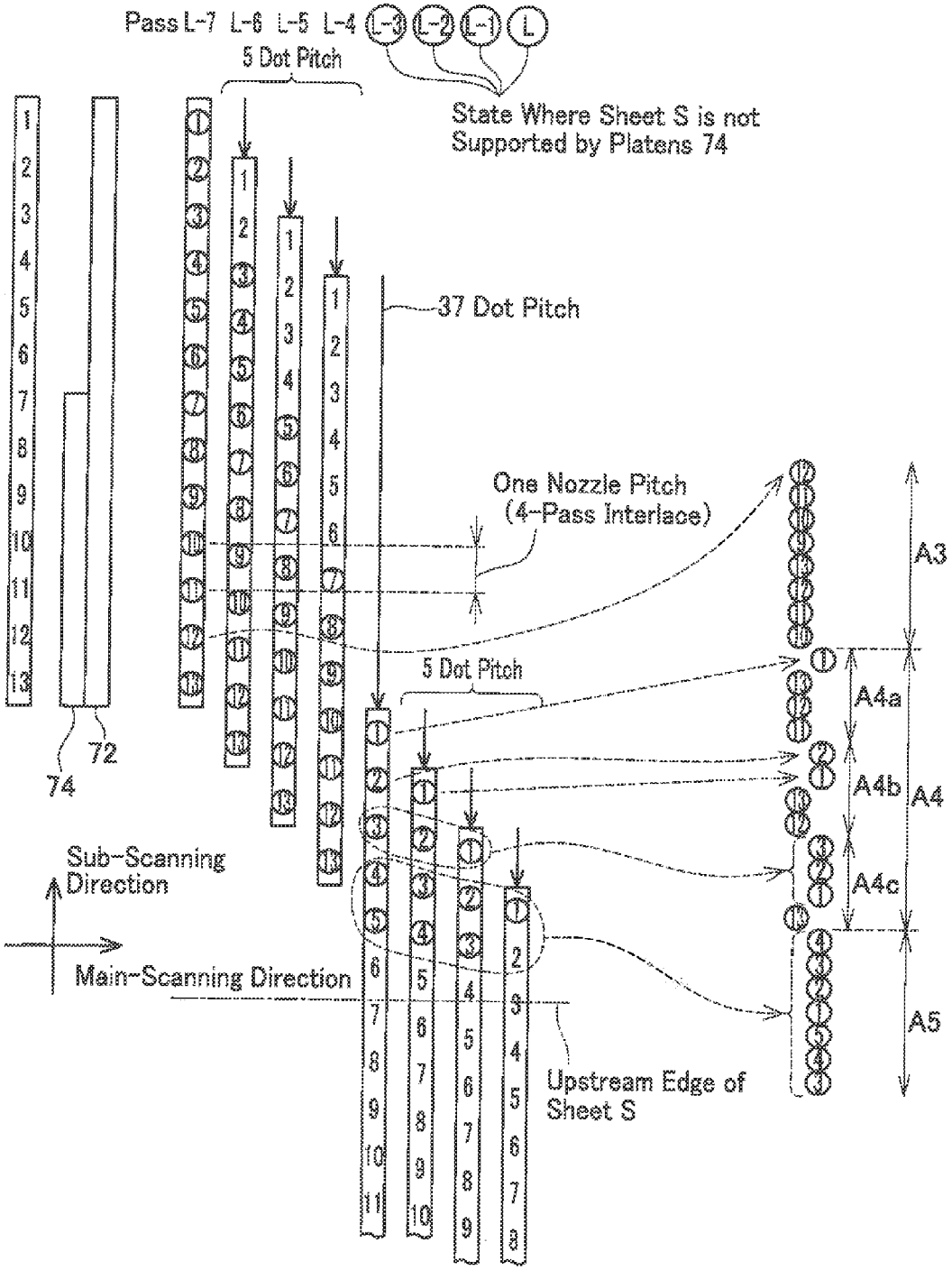
FIG. 10 shows how printing of each pass is performed in an end period of the special control.

(Details of Printing According to Special Control; FIG. 10)

Next, the manner in which printing is performed of the upstream side edge area (e.g., UEA of FIG. 8) on the sheet S in accordance with the special control will be described in detail with reference to FIG. 10. FIG. 10 shows printing of L-7 to L-th passes (e.g., the twelfth to nineteenth passes of FIG. 8). In the L-3 to L-th passes, the sheet S is in a state of not being supported by the platens 74.

In the L-6 to L-4 passes, the sheet S is transported by the small transportation amount (i.e., 5 dot pitch). In the L-7 to L-4 passes, the number of usage nozzles is sequentially reduced to "13", "11", "9", "7". Further, in the L-3 pass, the sheet S is transported by the large transportation amount (i.e., 37 dot pitch). Further, in the L-2 to L-th passes, the sheet S is transported by the small transportation amount (i.e., 5 dot pitch). In the L-3 to L-th passes, the number of usage nozzles is sequentially reduced to "5", "4", "3", "1".

FIG. 10 shows from the dot formed on the sheet S by nozzle [12] of the L-7 pass to the dot formed on the sheet S by nozzle [3] of the L-1 pass (i.e., the dot formed at the uppermost-stream side). Since the distance between the printing head PH and the sheet S increases in a state where the sheet S is not being supported by the platens 74 (i.e., the L-3 to L-th pass), each dot may be formed displaced from the target position. Area A3 is a good area, and area A4 is a bad area. An area A5 is an area in which each dot is aligned on a straight line along the sub-scanning direction due to each dot being formed displaced from the target position. Since each dot is aligned on a straight line, the area A5 can also be called a "good area".

(Banding; FIG. 7 and FIG. 10)

Next, the manner of banding being conspicuous to the user will be described for the case of the normal control of FIG. 7 and the case of the special control of FIG. 10. As described above, in the print result obtained from the normal control of FIG. 7, the banding is less conspicuous to the user compared to the print result obtained from the special control of FIG. 10, and a high-quality print result can be provided to the user. The following three reasons are considered to be the reasons for this.

Generally, banding is conspicuous to the user when the length of the sub-scanning direction of a bad area becomes small. The length in the sub-scanning direction of the bad area A4 of FIG. 10 (i.e., the vertical direction of FIG. 10) is shorter than the bad area A2 of FIG. 7. Thus, in the special control of FIG. 10, the length in the sub-scanning direction of the bad area A4 is short, and consequently the banding is conspicuous to the user. By contrast, in the normal control of FIG. 7, the length in the sub-scanning direction of the bad area A2 is large, and consequently the banding is not conspicuous to the user.

Further, generally, banding is conspicuous to the user in the case where a bad area is present between two good areas. In the special control of FIG. 10, the bad area A4 is present between the two good areas A3, A5, and consequently the banding is conspicuous to the user. On the other hand, in the normal control of FIG. 7, a good area is not present at an upstream side from the bad area A2, and consequently the banding is not conspicuous to the user.

Further, generally, the greater the change in dot pattern within a bad area, the more conspicuous the banding is to the user. In the special control of FIG. 10, the bad area A4 can be divided into three areas A4*a* to A4*c*. In the area A4*a*, the dots are formed displaced downstream by one dot, in the area A4*b* the dots are formed displaced downstream by two dots, and in the area A4*c* the dots are formed displaced downstream by three dots. Thus, in the special control of FIG. 10, there is a large change in the dot pattern of the three areas A4*a* to A4*c* within the bad area A4, and consequently the banding is conspicuous to the user. On the other hand, in the normal control of FIG. 7, the bad area A2 can be divided into four areas A2*a* to A2*d*. Of the four areas A2*a* to A2*d*, only the dot pattern of the area A2*d* is different from the dot pattern of the other three areas A2*a* to A2*c*. Thus, in the normal control of FIG. 7, the change in dot pattern of the four areas A2*a* to A2*d* within the bad area A2 is small, and consequently the banding is not conspicuous to the user.

The number of times of performing the main-scanning action while the sheet S is in a state of not being supported by the platens 74 (called "specific main-scanning action" below) is four times (L-3 to L-th pass) in the special control of FIG. 10, and two times (L-1 to L-th pass) in the normal control of FIG. 7. In the special control, the sheet S is transported by the large transportation amount, and consequently the sheet S must be transported by the small transportation amount before and after the large transportation amount (i.e., see the section TB and the section TD of FIG. 8). Consequently, the number of times that the specific main-scanning action is performed is comparatively large after the sheet S has been transported by the large transportation amount, and consequently the dot pattern shown in the areas A3 to A5 of FIG. 10 is formed. On the other hand, in the normal control, the sheet S is not transported by the large transportation amount, and therefore the sheet S does not need to be transported by the small transportation amount. Consequently, the number of times that the specific main-scanning action is performed is comparatively small, and consequently the dot pattern shown in the areas A1, A2 of FIG. 7 is formed. Thus, since the number of times of performing the specific main-scanning action is smaller in the normal control than in the special control, the banding is not conspicuous to the user, and a high-quality print result can be provided to the user.

Figure 11:
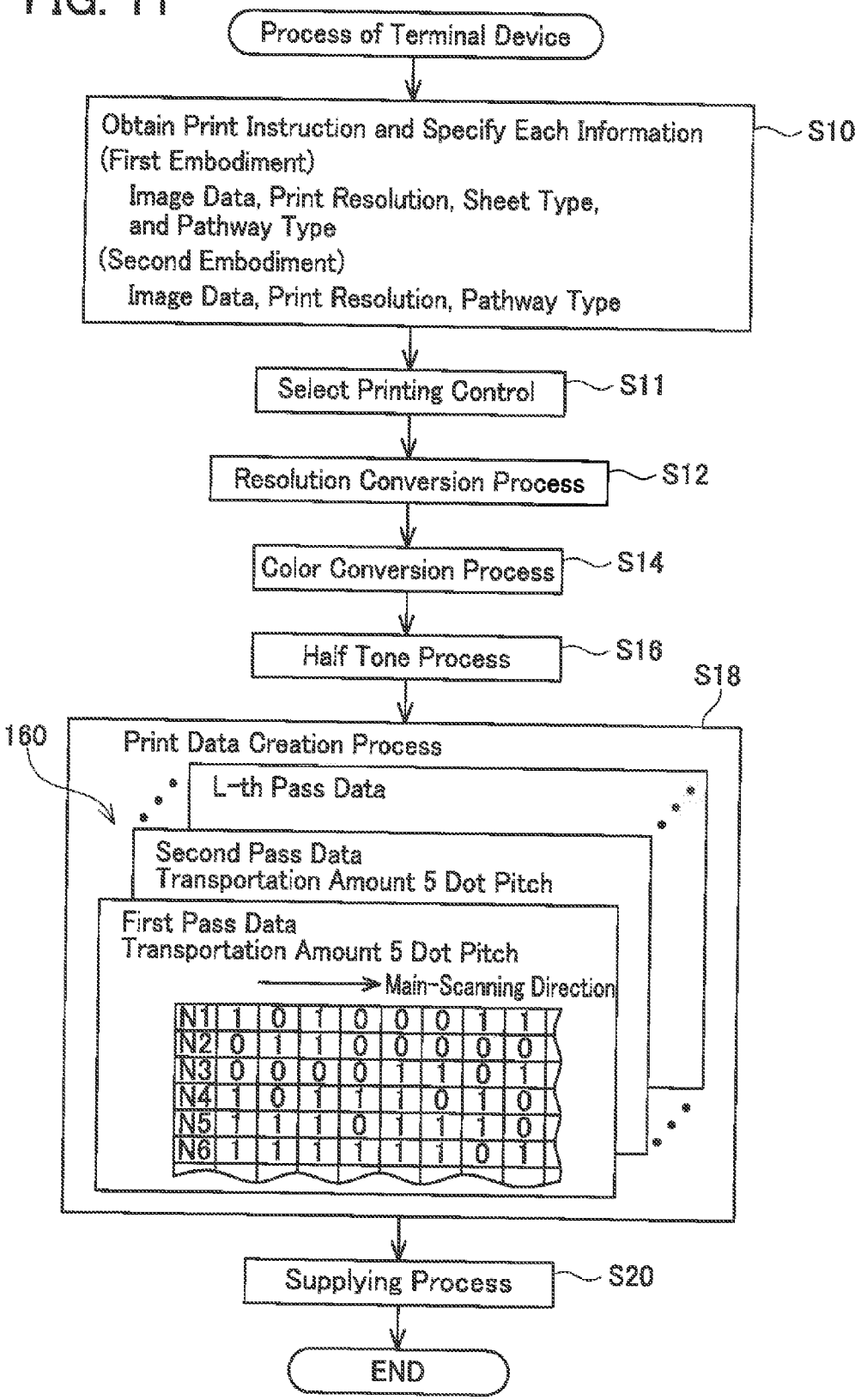
FIG. 11 shows a flowchart of processes performed by a terminal device.

(Process Performed by Terminal Device TR; FIG. 11)

Next, the contents of processes performed by the CPU 122 of the terminal device TR in accordance with the printer driver 126 will be described with reference to FIG. 11.

In S10, when the user performs a predetermined operation on the operation unit 104, the CPU 122 obtains a print instruction in accordance with the predetermined operation. The predetermined operation includes an operation of specifying image data representing the target image of the print target, an operation of specifying print quality (e.g., high-quality or low-quality), an operation for selecting the type of sheet S (called "sheet type" below) onto which the target image is to be printed from among the plural types of sheet (resin glossy sheet, to be described, etc.), and an operation for selecting the tray (i.e., the upper tray UT or the lower tray LT) supporting the sheet S onto which the target image is to be printed. The image data includes a plurality of pixel data, and each pixel data indicates a multi-tone (e.g., 256 gradations) RGB value. Further, based on the print instruction, the CPU 122 specifies the print resolution, the sheet type, the type of transportation pathway (called "pathway type" below) of the sheet S (i.e., upper feed or lower feed). Specifically, the CPU 122 specifies comparatively high print resolution in the case where high-quality was designated, and specifies comparatively low print resolution in the case where low-quality was designated. Further, the CPU 122 specifies the sheet type designated by the user. Further, the CPU 122 specifies the upper feed as the pathway type in the case where the upper tray UT was designated, and specifies the lower feed as the pathway type in the case where the lower tray LT was designated.

Moreover, in a modification, the tray need not be selected by the user. In this case, e.g., the CPU 122 obtains information from the printer PR indicating whether the sheet S is in a state of being supported or of not being supported by the upper tray UT. The CPU 122 specifies the upper feed as the pathway type in the case where the information indicates that the sheet S is being supported by the upper tray UT, and specifies the lower feed as the pathway type in the case where the information indicates that the sheet S is not being supported by the upper tray UT.

In S11, the CPU 122 selects, with reference to a printing control table DT1 (see FIG. 12, to be described) stored in advance in the memory 124, one type of printing control from among the normal control and the special control in accordance with the sheet type and the pathway type specified in S10.

In S12, the CPU 122 creates converted image data corresponding to the print resolution specified in S10 by performing a resolution conversion process on the image data specified in S10. The converted image data includes a plurality of pixel data (i.e., a number of pixel data corresponding to the print resolution specified in S10), and each pixel data indicates a multi-tone (e.g., 256 gradations) RGB value.

In S14, the CPU 122 performs a color conversion process on the converted image data created in S12, so as to create CMYK image data. The CMYK image data includes a plurality of pixel data (i.e., the same number of pixel data as the converted image data), and each pixel data indicates a multi-tone (e.g., 256 gradations) CMYK value.

In S16, the CPU 122 performs a half tone process (e.g., processing such as the error diffusion method, dither method, etc.) on the CMYK image data created in S14, so as to create binary data. The binary data includes a plurality of pixel data (i.e., the same number of pixel data as the CMYK image data), and each pixel data includes a two gradation (i.e., "1" or "0") CMYK value. The pixel data "1" indicates dot ON (i.e., discharge of ink), and the pixel data "0" indicates dot OFF (i.e., non-discharge of ink). In the present embodiment, the nozzles N1, etc. (see FIG. 2, etc.) formed in the printing head PH form dots on the sheet S by discharging black (K) ink droplets. Consequently, each pixel data within the binary data is constituted by K="1" or K="0". However, in the case where other nozzles than the nozzles N1, etc. are provided e.g., nozzle groups corresponding to CMY, the pixels within the binary data include not only values corresponding to K, but also values corresponding to CMY. Further, in the present embodiment, two gradation data indicating "1" or "0" is created. However, three or more gradation data may be created. For example, four gradation data: large dot ON, medium dot ON, small dot ON, and dot OFF, may be created.

In S18, the CPU 122 creates print data 160 based on the one type of printing control selected in S11 (i.e., normal control or special control), and the binary data created in S16. The print data 160 includes the pathway type information indicating the pathway type (i.e., the upper feed or the lower feed) specified in S10. The print data 160 further includes a plurality of pass data. One item of pass data corresponds to one pass (i.e., one main-scanning action). In each item of pass data, for each of the plurality of nozzles N1 to N9, the nozzle and the pixel data within the binary data are associated. For example, in the pass data of the first pass shown in S18 of FIG. 11, the pixel data associated with the nozzle N1, in sequence from left, shows "1", "0", "1", etc. This means that, during the first pass, ink droplets are discharged, ink droplets are not discharged, and ink droplets are discharged, in sequence, from the nozzle N1. The pass data further includes transportation amount data indicating a transportation amount in the sub-scanning direction of the sheet S. For example, the pass data of the first pass includes transportation amount data indicating 5 dot pitch. This means that the sheet S is transported by 5 dot pitch along the sub-scanning direction before the main-scanning action of the first pass is performed.

In the case where the normal control was selected in S11, the CPU 122 creates transportation amount data indicating n dot pitch (e.g., 13 dot pitch of FIG. 7) for each of the pass data of the first to sixteenth passes of FIG. 5. When creating the pass data of the first to sixteenth passes of FIG. 5, the CPU 122 further creates pixel data corresponding to each nozzle such that dots are formed by the usage nozzle group in the pass corresponding to the pass data. For example, in the L-3 pass of FIG. 7, since the usage nozzle group is nozzle [1] to nozzle [11], each pixel data corresponding to nozzle [1] to nozzle [11] may include "1 (i.e., dot ON)". However, each pixel data corresponding to the other nozzle [12] and nozzle [13] does not include "1" (i.e., includes only "0").

Further, in the case where the special control was selected in S11, the CPU 122 creates transportation amount data indicating n dot pitch for each of the pass data of the first to twelfth passes of FIG. 8, creates transportation amount data indicating the small transportation amount (e.g., 5 dot pitch) for each of the pass data of the twelfth to fifteenth passes, creates transportation amount data indicating the large transportation amount (e.g., 37 dot pitch) for the pass data of the sixteenth pass, and creates transportation amount data indicating the small transportation amount for the pass data of the seventeenth to nineteenth passes. When creating the pass data of the first to nineteenth passes of FIG. 8, the CPU 122 further creates pixel data corresponding to each nozzle.

In S20, the CPU 122 supplies the print data 160 created in S18 to the printer PR. Thereby, the control circuit 20 of the printer PR controls the sheet transportation unit TU and the head driving unit DU in accordance with the print data 160. For example, in the case where the pathway type information included in the print data 160 indicates the upper feed, the control circuit 20 drives the upstream motor UM (see FIG. 2) so as to transport the sheet S supported by the upper tray UT to the print starting position. Further, e.g., in the case where the pathway type information in the print data 160 indicates the lower feed, the control circuit 20 drives the feeding motor FM (see FIG. 2) and the upstream motor UM so as to transport the sheet S in the lower tray LT to the print starting position. Then, the control circuit 20 sequentially uses the pass data within the print data 160 to cause the sheet transportation unit TU to transport the sheet S according to the transportation amount data, and causes the head driving unit DU to perform the main-scanning action of the printing head PH according to the pixel data. Thereby, the target image represented by the print data 160 i.e., the target image represented by the image data obtained in S10, is printed onto the sheet S.

(Printing Control Table DT1; FIG. 12)

Next, contents of the printing control table DT1 used in S11 of FIG. 11 will be described with reference to FIG. 12. The pathway type (i.e., the upper feed and the lower feed), the sheet type, and the type of printing control (i.e., normal control and special control) are associated in the printing control table DT1. In the present embodiment, six types of sheet are adopted as the sheet type: resin glossy sheet, cast glossy sheet, inkjet sheet, normal sheet having a thickness equal to or above a predetermined thickness, normal sheet having a thickness less than the predetermined thickness, and OHP. Moreover, below, the former normal sheet and the latter normal sheet are called "normal sheet (thick sheet)" and "normal sheet (thin sheet)", respectively.

The resin glossy sheet includes a resin layer, and consequently, even if bent concavely or convexly along the transportation pathway, is hard to deform concavely or convexly toward the printing head PH after being in a state of not being supported by the upstream roller pairs UR. Further, the OHP also includes a resin layer, and consequently is comparatively hard to deform. Below, the resin glossy sheet and the OHP having such a feature are called "resin layer sheet". On the other hand, the cast glossy sheet, the inkjet sheet, and the normal sheet (thick sheet) do not include a resin layer. Consequently, this type of sheet, when bent concavely or convexly along the transportation pathway, easily deforms concavely or convexly toward the printing head PH after being in a state of not being supported by the upstream roller pairs UR. Below, the cast glossy sheet, etc. having such a feature are called "non-resin layer sheet". Further, the normal sheet (thin sheet) does not include a resin layer, but is thinner than the normal sheet (thick sheet). Consequently, the normal sheet (thin sheet), even if bent concavely or convexly along the transportation pathway, is hard to deform concavely or convexly toward the printing head PH after being in a state of not being supported by the upstream roller pairs UR. That is, in summary, the resin layer sheets and the normal sheet (thin sheet) are harder to deform during the transport process than the non-resin layer sheets.

As described above, the non-resin layer sheets (i.e., the cast glossy sheet, the inkjet sheet, the normal sheet (thick sheet)) deform comparatively easily. Consequently, when the non-resin layer sheet is concavely deformed by the upper feed, the upstream edge of the non-resin layer sheet may make contact with the lower surface of the printing head PH, and consequently the non-resin layer sheet may be contaminated (see (A2) of FIG. 4). Thus, in order to inhibit the contamination of the non-resin layer sheet due to concave deformation (i.e., curl), the special control, in which transportation by the large transportation amount is performed, is associated with the combination of the upper feed and the non-resin layer sheet in the printing control table DT1. Thereby, it is possible to inhibit the contamination of the non-resin layer sheet when the non-resin layer sheet is transported by the upper feed (see (A3) of FIG. 4). On the other hand, it is hard for the non-resin layer sheet to make contact with the lower surface of the printing head PH even if the non-resin layer sheet is deformed convexly by the lower feed (see (B2) of FIG. 4). Consequently, the normal control, in which transportation by the large transportation amount is not performed, is associated with the combination of the lower feed and the non-resin layer sheet in the printing control table DT1. Thereby, it is possible to inhibit banding conspicuous to the user (see (B2) of FIG. 4).

Further, the resin layer sheets (i.e., the resin glossy sheet, the OHP) are comparatively hard to deform. Consequently, since it is hard for the resin layer sheets to be deformed concavely by the upper feed, it is hard for the upstream edge of the resin layer sheets to make contact with the lower surface of the printing head PH. Consequently, the normal control is associated with the combination of the upper feed and the resin layer sheet in the printing control table DT1. Further, the normal control is also associated with the combination of the lower feed and the resin layer sheet. That is, the normal control is associated with the resin layer sheet regardless of the pathway type. Thereby, it is possible to inhibit banding conspicuous to the user.

Further, the normal sheet (thin sheet) is comparatively hard to deform but, when ink is absorbed, wavy wrinkles (so-called cockling) are easily formed. FIG. 12 shows how, viewed in the sub-scanning direction, wrinkles being bent in a wave-shape are formed on a normal sheet (thin sheet) used as the sheet S. Further, the manner of printing the thin sheet S in accordance with the normal control, and the manner of printing the thin sheet S in accordance with the special control, are shown in FIG. 12. The solid line indicates the position of the thin sheet S in the case where cockling does not occur, and the broken line indicates the position of an upper edge or lower edge of the thin sheet S in the case where cockling does occur. If the thin sheet S is transported in accordance with the normal control, when the upstream side edge of the thin sheet S is to be printed after the thin sheet S has separated from the upstream roller pairs UR, the length of the sheet portion located at the upstream side from the downstream roller pairs DR becomes large. Since the length of the sheet portion is large, a height Δ of the thin sheet S increases at the upstream edge (i.e., right edge) of the thin sheet S. Further, since the length of the sheet portion is large, the thin sheet S is supported by the platens 74, and the lower edge of the thin sheet S is located at an upper surface of the platens 74. Thus, since the height Δ of the thin sheet S is large, and the lower edge of the thin sheet S is located at the upper surface of the platens 74, the thin sheet S may make contact with the lower surface of the printing head PH when the printing head PH moves in the main-scanning direction. To avoid this, in the present embodiment, the thin sheet S is transported in accordance with the special control. That is, the special control is associated with the normal sheet (thin sheet) in the printing control table DT1 regardless of the pathway type. When the thin sheet S is transported in accordance with the special control, when printing is to be performed of the upstream side edge of the thin sheet S, the length of the sheet portion located at the upstream side from the downstream roller pairs DR becomes smaller. Since the length of the sheet portion is small, the height Δ of the thin sheet S becomes smaller at the upstream edge (i.e., right edge) of the thin sheet S. Further, since the length of the sheet portion is small, the thin sheet S is not supported by the platens 74, but the lower edge of the thin sheet S is located below the upper surface of the platens 74. Thus, since the height Δ of the thin sheet S is small, and the lower edge of the thin sheet S is located below the upper surface of the platens 74, it is possible to inhibit the thin sheet S from making contact with the lower surface of the printing head PH.

Effect of First Embodiment

According to the present embodiment, the terminal device TR specifies one sheet type from among plural types of sheet (i.e., the six types of sheets such as resin glossy sheet, etc. (see FIG. 12)), and specifies one pathway type from among the plural types of transportation pathway (i.e., the upper feed and the lower feed) (S10 of FIG. 11). Next, the terminal device TR selects one type of printing control from among the plural types of printing control (i.e., the normal control and the special control) in accordance with the specified sheet type and the specified pathway type (S11). Then, the terminal device TR creates the print data 160 in accordance with the selected one type of printing control (S12 to S18), and supplies the print data 160 to the printer PR (S20), thereby controlling the printer PR. Thereby, the printer PR transports the sheet S having the specified sheet type by using the specified pathway type, and prints the target image onto the sheet S in accordance with the selected one type of printing control. Consequently, the printer PR is able to print the target image onto the sheet S in accordance with the combination of the pathway type and the sheet type while inhibiting contamination of the sheet S due to deformation of the sheet S during transport, inhibiting conspicuous banding, and inhibiting contamination of the sheet S due to cockling. Thus, according to the present embodiment, the terminal device TR can appropriately cause the printer PR to print the target image onto the sheet S.

(Correspondence Relationship)

The printer PR and the terminal device TR are examples of "print performing unit" and "control device", respectively. The sub-scanning direction and the main-scanning direction are examples of "first direction" and "second direction", respectively. The lower feed and the upper feed are examples of "first type of transportation pathway" and "second type of transportation pathway", respectively. The normal control and the special control are examples of "first type of printing control" and "second type of printing control", respectively. The non-resin layer sheet, the resin layer sheet, and the normal sheet (thin sheet) are examples of "first type of print medium", "second type of print medium" and "third type of print medium", respectively. n dot pitch (e.g., 13 dot pitch of FIG. 7) and large transportation amount (e.g., 37 dot pitch of FIG. 10) are examples of "first transportation amount" and "second transportation amount", respectively. In FIG. 8 and FIG. 9, the main-scanning action of the thirteenth to fifteenth passes, and the main-scanning action of the sixteenth to nineteenth passes are examples of "first type of main-scanning action" and "second type of main-scanning action", respectively. Further, in FIG. 6, the main-scanning action of the thirteenth to sixteenth passes is an example of "third type of main-scanning action".

Second Embodiment

In the present embodiment, the processes S10 and S11 of FIG. 11 are different from those of the first embodiment. In S10, the CPU 122 of the terminal device TR specifies the image data, the print resolution and the pathway type without specifying the sheet type. In S11, the CPU 122 selects, with reference to a printing control table DT2 of FIG. 12, one type of printing control (i.e., the normal control or the special control) in accordance with the pathway type specified in S10.

In the printing control table DT2, the sheet type is not present, the special control is associated with the upper feed, and the normal control is associated with the lower feed. That is, when the sheet S is concavely deformed by the upper feed, the upstream edge of the sheet S may make contact with the lower surface of the printing head PH, and consequently the sheet S may be contaminated (see (A2) of FIG. 4). To avoid this, in the printing control table DT2, the special control is associated with the upper feed. Thereby, it is possible to inhibit the contamination of the sheet S when the sheet S is transported by the upper feed (see (A3) of FIG. 4). On the other hand, even if the sheet S is convexly deformed by the lower feed, it is hard for the sheet S to make contact with the lower surface of the printing head PH (see (B2) of FIG. 4). Consequently, in the printing control table DT2, the normal control is associated with the lower feed. Thereby, it is possible to inhibit banding conspicuous to the user (see (B2) of FIG. 4). For example, in the case where the printer PR can print only on the normal sheet (thick sheet), the terminal device TR can appropriately cause the printer PR to print the target image onto the sheet S without consideration of the sheet type as in the present embodiment.

(Modification 1)

In the above embodiments, e.g., in the normal control of FIG. 5, the sheet S is transported by the same transportation amount (i.e., n dot pitch) in all of the first to sixteenth passes. That is, the transportation amount when the downstream side edge area and/or the upstream side edge area UEA on the sheet S is to be printed (called "edge portion transportation amount" below) is the same as the transportation amount when the central area CA on the sheet S is to be printed (called "central transportation amount" below). Instead, the edge portion transportation amount may be a transportation amount smaller than the central transportation amount. Generally speaking, in "first type of printing control", when an edge image is to be printed on an edge area, the medium transportation unit need not transport the target print medium by a transportation amount greater than the first transportation amount.

(Modification 2)

In the above embodiments, e.g., in the special control of FIG. 8, the sheet S is transported by the large transportation amount when the upstream side edge area UEA on the sheet S is to be printed, but the sheet S is not transported by the large transportation amount when the downstream side edge area on the sheet S is to be printed. Instead, in the special control, the sheet S may be transported by the large transportation amount in each of when the upstream side edge area UEA is to be printed, and when the downstream side edge area is to be printed. For example, in a state where the downstream edge of the sheet S is located just a little downstream from the upstream roller pairs UR, the downstream side edge area on the sheet S is printed, then the sheet S is transported by the large transportation amount, and the sheet S is supported by both the upstream roller pairs UR and the downstream roller pairs DR. Thereby, it is possible to inhibit an increase in the length of the sheet portion located downstream from the upstream roller pairs UR while the sheet S is in a state of being supported only by the upstream roller pairs UR. Consequently, it is possible to inhibit the downstream edge of the sheet S making contact with the lower surface of the printing head PH due to the concave deformation of the sheet S transported by the upper feed. Generally speaking, "edge area" may be an area on a target print medium located at an upstream side in a first direction, or may be an area located at a downstream side thereof.

(Modification 3)

In the above embodiments, as shown in FIG. 7 and FIG. 10, a plurality of rasters is formed within the length of one nozzle pitch on the sheet S (i.e., interlace printing is performed). Instead, one raster may be formed within the length of one nozzle pitch on the sheet S (i.e., interlace printing may not be performed). In particular, the one raster may be formed by a plurality of main-scanning actions (called "shingling printing" below), or may be formed by one main-scanning action (called "normal printing" below). Further, printing may be performed by combining interlace printing and shingling printing. Generally, in the case where k rasters (k being an integer equal to or greater than 1) within the length of one nozzle pitch are formed by k x j times of main-scanning action, the transportation amount of the normal control (i.e., the transportation amount of the section TA (see FIG. 8) of the special control) is represented by "$k \times X+b$ (dot pitch)". Here, "j" is the number of times of main-scanning action needed to form one raster. Further, "b" and "X" are, respectively, integers satisfying (formula 1) "$-(1/2)\times k<b\leq(1/2)\times k$", and (formula 2) "$n=(k\times X+b)\times j$". In the interlace printing of FIG. 7, k=4, j=1, and n=13. According to (formula 1), b=−1, 0, 1, or 2. According to (formula 2), "$13=(4\times X+b)\times 1$". Consequently, X=3 and b=1, and the transportation amount is 13 dot pitch (i.e., $(4\times 3+1)$ dot pitch). Further, in the case where interlace printing is not performed, and shingling printing of four passes is performed, k=1 and j=4 and, according to (formula 1), b=0. Further, e.g., in the case where n=8, according to (formula 2), "$8=(1\times X+0)\times 4$". Consequently, X=2, and the transportation amount is 2 dot pitch (i.e., $(1\times 2+0)$ dot pitch). Further, in the case where the normal printing is performed, k=1 and j=1 and, according to (formula 1), b=0. For example, in the case where n=8, according to (formula 2), "$8=(1\times X+0)\times 1$". Consequently, X=8, and the transportation amount is 8 dot pitch (i.e., $(1\times 8+0)$ dot pitch). Further, e.g., in the case where interlace printing of four passes and interlace printing of two passes are combined, k=4 and j=2, and four rasters within the length of one nozzle pitch are formed by eight times (i.e., 4×2 times) of main-scanning action. According to (formula 1), b=−1, 0, 1, or 2. For example, in the case where n=18, according to (formula 2), "$18=(4\times X+b)\times 2$". Consequently, x=2 and b=1, and the transportation amount is 9 dot pitch (i.e., $(4\times 2+1)$ dot pitch).

(Modification 4)

In the above embodiments, a roller pair including a driving roller and a driven roller are used in the upstream roller pair UR and the downstream roller pair DR. However, a driven roller may be omitted. In this case, the sheet S may be supported between the driving roller and a member having a flat surface. That is, each of the "upstream side roller" and the "downstream side roller" may be configured by at least one roller.

(Modification 5)

In the above embodiments, the CPU 122 of the terminal device TR creates the print data 160, and supplies the print data 160 to the printer PR (see FIG. 11). Instead, the control circuit 20 of the printer PR may obtain, from the terminal device TR, a print instruction including image data, print resolution (i.e., information indicating print quality), sheet type (capable of being omitted in the second embodiment) and pathway type (i.e., information indicating tray), and perform the processes of S10 to S18 of FIG. 11 in accordance with the print instruction, so as to create the print data 160. In this case, the control circuit 20 controls the printing engine PE by supplying the print data 160 to the printing engine PE. In the present modification, the printing engine PE and the control circuit 20 of the printer PR are examples of "print performing unit" and "control device", respectively.

(Modification 6)

The control circuit 20 of the printer PR may not obtain the print instruction from the terminal device TR. For example, the control circuit 20 obtains the image data from a USB memory or the like connected with the printer PR. Further, the control circuit 20 specifies the print resolution, the sheet type (omitted in the second embodiment) and the pathway type in accordance with an operation by the user on an operation panel of the printer PR. Other processes are the same as in modification 5. In the present modification, also, the printing engine PE and the control circuit 20 of the printer PR are examples of "print performing unit" and "control device", respectively.

(Modification 7)

In the above embodiments, the processes of FIG. 11 are realized by the CPU 122 of the terminal device TR executing the printer driver 126 (i.e., software). Instead, at least one process of the processes of FIG. 11 may be realized by hardware such as a logic circuit or the like.

The invention claimed is:

1. A control device configured to cause a print performing unit to perform printing, wherein the print performing unit comprises:

a printing head comprising a plurality of nozzles which align along a first direction;

a medium transportation unit configured to transport a print medium toward the printing head by using one of plural types of transportation pathways, the plural types of transportation pathways including a first type of transportation pathway that bends the print medium such that the print medium is deformed convexly toward the printing head and a second type of transportation pathway that bends the print medium such that the print medium is deformed concavely toward the printing head;

a head driving unit configured to cause the printing head to perform a main-scanning action, the main-scanning action including an action for causing the printing head to discharge an ink toward the print medium while causing the printing head to move along a second direction which is perpendicular to the first direction, the control device comprising:

a processor; and a memory storing computer-readable instructions which, when executed by the processor, cause the control device to execute:

specifying a type of a target print medium to be used for printing from among plural types of print mediums;

specifying a type of a target transportation pathway to be used for transporting the target print medium from among the plural types of transportation pathways;

selecting, in accordance with the specified type of the target print medium and the specified type of the target transportation pathway, one type of printing control from among plural types of printing controls including a first type of printing control and a second type of printing control; and controlling the print performing unit in accordance with the selected one type of printing control so as to cause the print performing unit to perform printing of a target image on the target print medium, wherein in each of the first type of printing control and the second type of printing control, the medium transportation unit sequentially transports a plurality of times, from an upstream side to a downstream side along the first direction, the target print medium which has been transported along the target transportation pathway, and the head driving unit causes the printing head to perform the main-scanning action each time the target print medium is transported, in each of the first type of printing control and the second type of printing control, when a central image among the target image is to be printed on a central area which is located at a central portion along the first direction on the target print medium, the medium transportation unit sequentially transports the target print medium more than once by a first transportation amount, in the first type of printing control, when an edge image among the target image is to be printed on an edge area which is located at an edge portion along the first direction on the target print medium, the medium transportation unit does not transport the target print medium by a transportation amount which is greater than the first transportation amount, and in the second type of printing control, when the edge image among the target image is to be printed on the edge area on the target print medium, the medium transportation unit transports the target print medium by a second transportation amount which is greater than the first transportation amount.

2. The control device as in claim 1, wherein the edge area is located at the upstream side along the first direction on the target print medium, in the second type of printing control, when the edge image among the target image is to be printed on the edge area on the target print medium, the head driving unit causes the printing head to perform a first type of main-scanning action before the target print medium is transported by the second transportation amount, and causes the printing head to perform a second type of main-scanning action after the target print medium is transported by the second transportation amount, in the first type of main-scanning action, a downstream nozzle group is not used and a upstream nozzle group is used, the downstream nozzle group being located at the downstream side along the first direction among the plurality of nozzles, and the upstream nozzle group being located at the upstream side along the first direction among the plurality of nozzles, and in the second type of main-scanning action, the upstream nozzle group is not used and the downstream nozzle group is used.

3. The control device as in claim 2, wherein in the first type of printing control, when the edge image among the target image is to be printed on the edge area on the target print medium, the head driving unit causes the printing head to perform a third type of main-scanning action, in the third type of main-scanning action, the downstream nozzle group is continuously used.

4. The control device as in claim 1, wherein the selecting of the one type of printing control includes:

selecting the first type of printing control in a case where a first type of print medium is specified and the first type of transportation pathway is specified; and selecting the second type of printing control in a case where the first type of print medium is specified and the second type of transportation pathway is specified.

5. The control device as in claim 4, wherein the selecting of the one type of printing control further includes:

selecting the first type of printing control in a case where a second type of print medium being different from the first type of print medium is specified and the first type of transportation pathway is specified; and selecting the first type of printing control in a case where the second type of print medium is specified and the second type of transportation pathway is specified.

6. The control device as in claim 5, wherein compared to the first type of print medium, the second type of print medium is hard to deform convexly or concavely toward the printing head in a process of being transported along the first type of transportation pathway or the second type of transportation pathway.

7. The control device as in claim 5, wherein the first type of print medium does not include a resin layer, and the second type of print medium includes a resin layer.

8. The control device as in claim 4, wherein the selecting of the one type of printing control further includes:

selecting the second type of printing control in a case where a third type of print medium being different from the first type of print medium is specified and the first type of transportation pathway is specified; and selecting the second type of printing control in a case where the third type of print medium is specified and the second type of transportation pathway is specified.

9. The control device as in claim 8, wherein compared to the first type of print medium, the third type of print medium is hard to deform convexly or concavely toward the printing head in a process of being transported along the first type of transportation pathway or the second type of transportation pathway.

10. The control device as in claim 8, wherein the third type of print medium is thinner than the first type of print medium.

11. The control device as in claim 1, wherein the selecting of the one type of printing control includes:

selecting the second type of printing control in a case where a first type of print medium is specified and the second type of transportation pathway is specified; and selecting the first type of printing control in a case where a second type of print medium being different from the first type of print medium is specified and the second type of transportation pathway is specified.

12. The control device as in claim 1, wherein the selecting of the one type of printing control includes:

selecting the second type of printing control in a case where a first type of print medium is specified and the second type of transportation pathway is specified; and selecting the second type of printing control in a case where a third type of print medium being different from the first type of print medium is specified and the second type of transportation pathway is specified.

13. The control device as in claim 1, wherein the selecting of the one type of printing control includes:

selecting the first type of printing control in a case where a first type of print medium is specified and the first type of transportation pathway is specified; and selecting the second type of printing control in a case where a third type of print medium being different from the first type of print medium is specified and the first type of transportation pathway is specified.

14. The control device as in claim 1, wherein the selecting of the one type of printing control includes:

selecting the first type of printing control in a case where a first type of print medium is specified and the first type of transportation pathway is specified; and selecting the first type of printing control in a case where a second type of print medium being different from the first type of print medium is specified and the first type of transportation pathway is specified.

15. A control device configured to cause a print performing unit to perform printing, wherein the print performing unit comprise:

a printing head comprising a plurality of nozzles which align along a first direction;

a medium transportation unit configured to transport a print medium toward the printing head by using one of plural types of transportation pathways, the plural types of transportation pathways including a first type of transportation pathway that bends the print medium such that the print medium is deformed convexly toward the printing head and a second type of transportation pathway that bends the print medium such that the print medium is deformed concavely toward the printing head;

a head driving unit configured to cause the printing head to perform a main-scanning action, the main-scanning action including an action for causing the printing head to discharge an ink toward the print medium while causing the printing head to move along a second direction which is perpendicular to the first direction, the control device comprising:

a processor; and a memory storing computer-readable instructions which, when executed by the processor, cause the control device to execute:

specifying a type of a target transportation pathway to be used for transporting a target print medium to be used for printing from among the plural types of transportation pathways;

selecting, in accordance with the specified type of the target transportation pathway, one type of printing control from among plural types of printing controls including a first type of printing control and a second type of printing control; and controlling the print performing unit in accordance with the selected one type of printing control so as to cause the print performing unit to perform printing of a target image on the target print medium, wherein in each of the first type of printing control and the second type of printing control, the medium transportation unit sequentially transports a plurality of times, from an upstream side to a downstream side along the first direction, the target print medium which has been transported along the target transportation pathway, and the head driving unit causes the printing head to perform the main-scanning action each time the target print medium is transported, in each of the first type of printing control and the second type of printing control, when a central image among the target image is to be printed on a central area which is located at a central portion along the first direction on the target print medium, the medium transportation unit sequentially transports the target print medium more than once by a first transportation amount, in the first type of printing control, when an edge image among the target image is to be printed on an edge area which is located at an edge portion along the first direction on the target print medium, the medium transportation unit does not transport the target print medium by a transportation amount which is greater than the first transportation amount, and in the second type of printing control, when the edge image among the target image is to be printed on the edge area on the target print medium, the medium transportation unit transports the target print medium by a second transportation amount which is greater than the first transportation amount.

16. The control device as in claim 15, wherein the edge area is located at the upstream side along the first direction on the target print medium, in the second type of printing control, when the edge image among the target image is to be printed on the edge area on the target print medium, the head driving unit causes the printing head to perform a first type of main-scanning action before the target print medium is transported by the second transportation amount, and causes the printing head to perform a second type of main-scanning action after the target print medium is transported by the second transportation amount, in the first type of main-scanning action, a downstream nozzle group is not used and a upstream nozzle group is used, the downstream nozzle group being located at the downstream side along the first direction among the plurality of nozzles, and the upstream nozzle group being located at the upstream side along the first direction among the plurality of nozzles, and in the second type of main-scanning action, the upstream nozzle group is not used and the downstream nozzle group is used.

17. The control device as in claim 16, wherein in the first type of printing control, when the edge image among the target image is to be printed on the edge area on the target print medium, the head driving unit causes the printing head to perform a third type of main-scanning action, in the third type of main-scanning action, the downstream nozzle group is continuously used.

18. A non-transitory computer-readable recording medium storing computer-readable instructions for a control device configured to cause a print performing unit to perform printing, wherein the print performing unit comprises:

a printing head comprising a plurality of nozzles which align along a first direction;

a medium transportation unit configured to transport a print medium toward the printing head by using one of plural types of transportation pathways, the plural types of transportation pathways including a first type of transportation pathway that bends the print medium such that the print medium is deformed convexly toward the printing head and a second type of transportation pathway that bends the print medium such that the print medium is deformed concavely toward the printing head;

a head driving unit configured to cause the printing head to perform a main-scanning action, the main-scanning action including an action for causing the printing head to discharge an ink toward the print medium while causing the printing head to move along a second direction which is perpendicular to the first direction, the computer-readable instructions, when executed by a processor of the control device, causing the control device to execute:

specifying a type of a target print medium to be used for printing from among plural types of print mediums;

specifying a type of a target transportation pathway to be used for transporting the target print medium from among the plural types of transportation pathways;

selecting, in accordance with the specified type of the target print medium and the specified type of the target transportation pathway, one type of printing control from among plural types of printing controls including a first type of printing control and a second type of printing control; and controlling the print performing unit in accordance with the selected one type of printing control so as to cause the print performing unit to perform printing of a target image on the target print medium, wherein in each of the first type of printing control and the second type of printing control, the medium transportation unit sequentially transports a plurality of times, from an upstream side to a downstream side along the first direction, the target print medium which has been transported along the target transportation pathway, and the head driving unit causes the printing head to perform the main-scanning action each time the target print medium is transported, in each of the first type of printing control and the second type of printing control, when a central image among the target image is to be printed on a central area which is located at a central portion along the first direction on the target print medium, the medium transportation unit sequentially transports the target print medium more than once by a first transportation amount, in the first type of printing control, when an edge image among the target image is to be printed on an edge area which is located at an edge portion along the first direction on the target print medium, the medium transportation unit does not transport the target print medium by a transportation amount which is greater than the first transportation amount, and in the second type of printing control, when the edge image among the target image is to be printed on the edge area on the target print medium, the medium transportation unit transports the target print medium by a second transportation amount which is greater than the first transportation amount.

19. A non-transitory computer-readable recording medium storing computer-readable instructions for a control device configured to cause a print performing unit to perform printing, wherein the print performing unit comprises:

a printing head comprising a plurality of nozzles which align along a first direction;

a medium transportation unit configured to transport a print medium toward the printing head by using one of plural types of transportation pathways, the plural types of transportation pathways including a first type of transportation pathway that bends the print medium such that the print medium is deformed convexly toward the printing head and a second type of transportation pathway that bends the print medium such that the print medium is deformed concavely toward the printing head;

a head driving unit configured to cause the printing head to perform a main-scanning action, the main-scanning action including an action for causing the printing head to discharge an ink toward the print medium while causing the printing head to move along a second direction which is perpendicular to the first direction, the computer-readable instructions, when executed by a processor of the control device, causing the control device to execute:

specifying a type of a target transportation pathway to be used for transporting a target print medium to be used for printing from among the plural types of transportation pathways;

selecting, in accordance with the specified type of the target transportation pathway, one type of printing control from among plural types of printing controls including a first type of printing control and a second type of printing control; and controlling the print performing unit in accordance with the selected one type of printing control so as to cause the print performing unit to perform printing of a target image on the target print medium, wherein in each of the first type of printing control and the second type of printing control, the medium transportation unit sequentially transports a plurality of times, from an upstream side to a downstream side along the first direction, the target print medium which has been transported along the target transportation pathway, and the head driving unit causes the printing head to perform the main-scanning action each time the target print medium is transported, in each of the first type of printing control and the second type of printing control, when a central image among the target image is to be printed on a central area which is located at a central portion along the first direction on the target print medium, the medium transportation unit sequentially transports the target print medium more than once by a first transportation amount, in the first type of printing control, when an edge image among the target image is to be printed on an edge area which is located at an edge portion along the first direction on the target print medium, the medium transportation unit does not transport the target print medium by a transportation amount which is greater than the first transportation amount, and in the second type of printing control, when the edge image among the target image is to be printed on the edge area on the target print medium, the medium transportation unit transports the target print medium by a second transportation amount which is greater than the first transportation amount.

* * * * *